US005390614A

United States Patent [19]

Adamski, Jr. et al.

[11] Patent Number: 5,390,614

[45] Date of Patent: Feb. 21, 1995

[54] METHOD AND APPARATUS FOR AUTOMATICALLY ATTACHING A COLLARETTE DISPLAY AND LABEL TO A GARMENT BODY BY USING A TWO STEP SEWING OPERATION

[75] Inventors: Maximilian Adamski, Jr., Tega Cay, S.C.; Kenneth C. Milner, Lake Zurich, Ill.; Edward R. LaVelle, Staley; John C. McEwen, Mocksville, both of N.C.

[73] Assignees: Union Special Corporation, Huntley, Ill.; Sara Lee Corporation, Winston-Salem, N.C.

[21] Appl. No.: 961,470

[22] Filed: Oct. 23, 1992

Related U.S. Application Data

[63] Continuation-in-part of Ser. No. 711,315, Jun. 6, 1991.

[51] Int. Cl.[6] ..... D05B 19/00; D05B 25/00; D05B 35/06

[52] U.S. Cl. ..... 112/121.11; 112/155; 112/113; 112/262.3; 112/265.1

[58] Field of Search ..... 112/121.11, 155, 104, 112/113, 152, 121.27, 265.1, 262.3, 147

[56] References Cited

U.S. PATENT DOCUMENTS

| | | | |
|---|---|---|---|
| 3,664,284 | 5/1972 | Hester . | |
| 3,750,603 | 8/1973 | Martin . | |
| 4,432,294 | 2/1984 | Price et al. . | |
| 4,432,295 | 2/1984 | Raisin et al. | 112/155 |
| 4,611,546 | 9/1986 | Miyakawa . | |
| 4,624,198 | 11/1986 | Beam et al. | 112/121.15 X |
| 4,901,658 | 2/1990 | Sanvito et al. | 112/155 |
| 5,040,472 | 8/1991 | Schips . | |

FOREIGN PATENT DOCUMENTS

| | | |
|---|---|---|
| 2594013 | 2/1986 | France . |
| 2277487 | 11/1990 | Japan . |

OTHER PUBLICATIONS

English translation of Abstract of Japanese patent No. 2277-487-A, issued Nov. 14, 1990.

English translation of Abstract of French Patent No. 2 594 013, dated Feb. 12, 1986.

*Primary Examiner*—Peter Nerbun

*Attorney, Agent, or Firm*—Morgan & Finnegan

[57] ABSTRACT

An improved method and apparatus for attaching a collarette, display, and label to a garment body incorporating the use of a first sewing machine having a sewing head for sewing the collarette, display, label and garment body into a sewn assembly. The device includes a collarette feeder, a display feeder, a label feeder synchronized with the sewing head, a garment detector, a seam detector, a stitch counter, and a controller to control each device and perform necessary calculations. A conveyor system is provided to transport the sewn assembly to a second sewing machine for sewing the display in place to cover the overedge seam affixing the components. A collarette unfolded and a display unfolded are disposed along the path of the sewn assembly to position the collarette and display for processing at the second sewing machine. A cutter assembly is also provided to sever the collarette once the display has been sewn in place.

25 Claims, 22 Drawing Sheets

FIG. 7
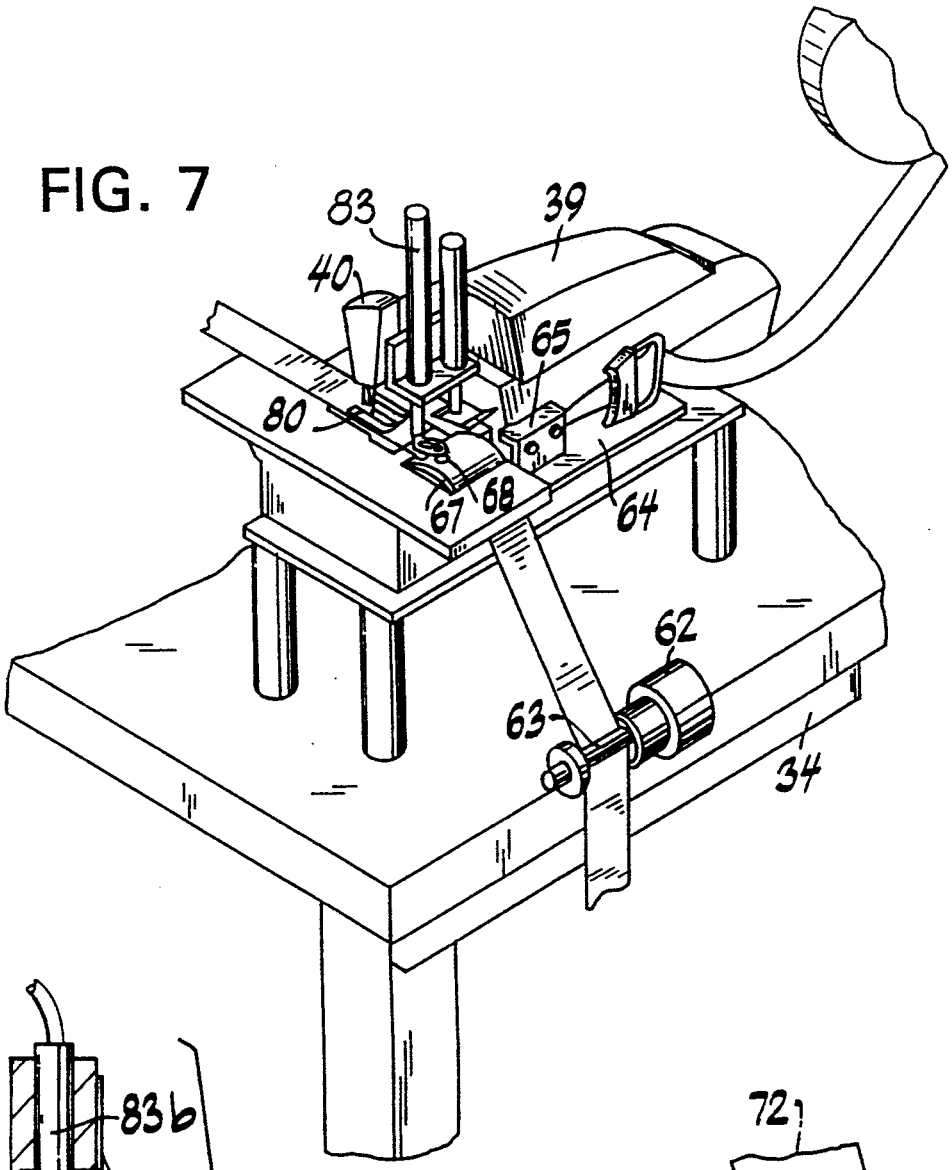
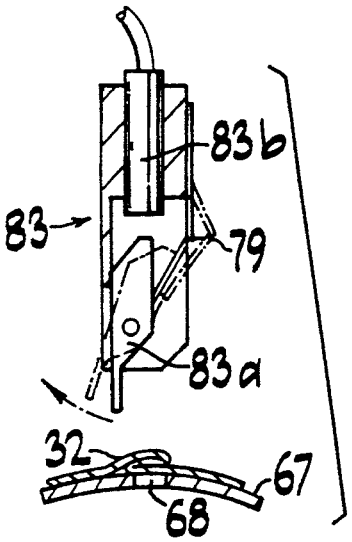
FIG. 8A
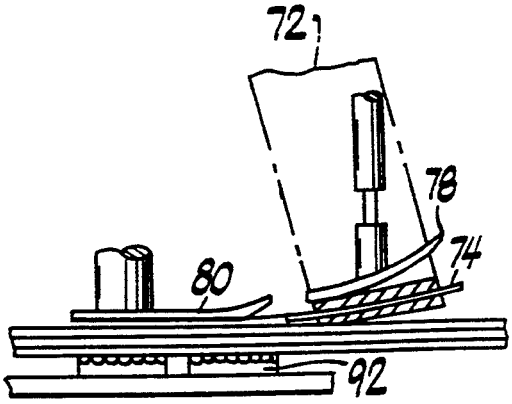
FIG. 8B

FIRST FOLDER

FIG. 9C
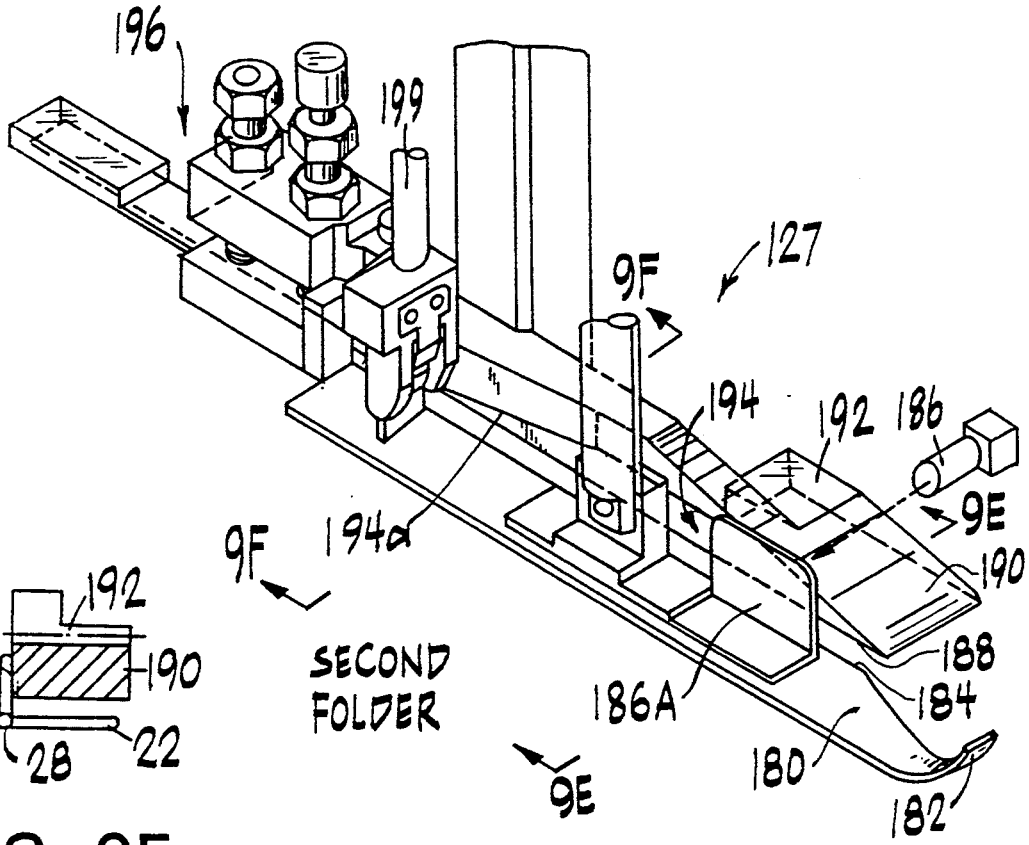
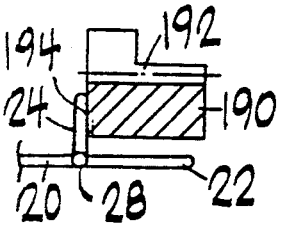
FIG. 9E
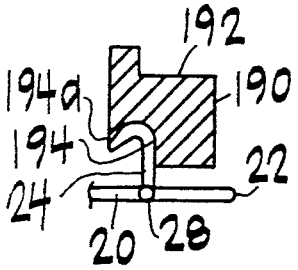
FIG. 9F
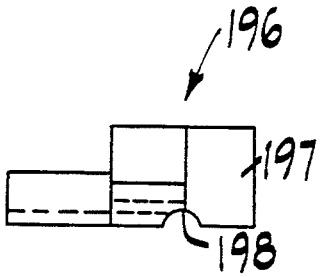
FIG. 9D

2ND SEWING MACHINE

METHOD AND APPARATUS FOR AUTOMATICALLY ATTACHING A COLLARETTE DISPLAY AND LABEL TO A GARMENT BODY BY USING A TWO STEP SEWING OPERATION

CROSS REFERENCE TO RELATED APPLICATIONS

This application is a continuation-in-part of Applicants' co-pending application Ser. No. 07/711,315, filed Jun. 6, 1991.

BACKGROUND OF THE INVENTION 1. Field of the Invention

The present invention relates to an improved method and apparatus for automatically attaching a collarette, display, and label to a garment body by synchronized sewing and material feeding.

2. Description of the Prior Art

Garments such as shirts or blouses are typically manufactured using manual labor. Garment pieces are cut out of stock material, trimmed to proper dimensions, and then sewn together on a sewing machine by a sewing machine operator.

Often in garment manufacturing, a piece of material, known in the art as a "collarette" is folded and sewn around the garment neck to form a continuous collar. The conventional method of sewing a collarette to a garment neck is performed by a sewing machine operator in the following manner. First, the collarette is cut to a size slightly shorter than the garment neck edge where the collarette is to be sewn. Then, the operator positions the collarette on top of the garment body, places the material under a sewing machine and starts sewing. While sewing, the operator must continually maintain the alignment of the collarette and garment body to obtain an evenly manufactured finished product. Additionally, the operator must pull and stretch the collarette during the sewing operation. Stretching the collarette in such a manner will cause the completed garment and collarette to lie flat and have no wrinkles or gathers around the neck when worn.

The operator may also be required to attach a label (e.g. a manufacturer's identifier having the manufacturer's name and product information) to the garment with the same stitch being used to attach the collarette to the garment. To perform this operation, the operator must carefully position and hold the label in the desired location while sewing.

Additionally, the operator may be required to sew a small strip of material, known in the art as a "display", to the inside of the garment neck to flatten and cover the seam joining the collarette and label to the garment body (the "joining seam"). The display is used to cover the area inside the garment where the joining seam would be partially visible after the garment is packaged for sale, i.e., on the inside back portion of the garment neck. To sew a display, the operator must carefully position the display on top or bottom of the collarette and garment body and hold the display in position while sewing.

Further complications to the above-described conventional sewing operation are encountered when the joining seam (known as an "overedge seam") is to be hidden from view from the outside of the garment (i.e. the side of the garment away from the body of the wearer). To hide the overedge seam, an operator must layer the collarette, display, and label on top or bottom of the garment body, and use an "overedge stitch" to join the pieces together. The resulting overedge seam is then hidden from the outside of the finished garment. To sew a collarette, label, and display to a garment body with an overedge stitch, an operator must first manually arrange and layer the materials one on top of the other as follows: garment body, collarette, label and display. The operator then passes the layered materials through the sewing machine, maintaining them in constant alignment while stretching the collarette as described above. If desired, a second sewing operation is then performed to attach the loose edge of the display to garment body with a cover stitch to assure that the display covers the overedge seam and a portion of the label.

The manual process of sewing a collarette, label and display to a garment body is difficult and tedious. The quality of the finished product is often variable and is largely dependent on the experience and skill of the sewing machine operator. Moreover, the conventional process is time consuming due to the need to precisely arrange and sew the materials together.

A partial solution to the above-identified problems is disclosed in co-pending patent application U.S. Ser. No. 07/711,659, filed Jun. 6, 1991 for a METHOD AND APPARATUS FOR AUTOMATICALLY ATTACHING A COLLARETTE, DISPLAY, AND LABEL TO A GARMENT BODY, assigned to Sara Lee Corporation, one of the assignees herein, the disclosure of which is hereby incorporated by reference herein. U.S. Ser. No. 07/711,659 discloses a method and apparatus for automatically attaching a collarette, display, and label to a garment body using, inter alia, a collarette feed means, display feed means, label feed means and a controller means. As disclosed therein, the controller means counts the total number of stitches since the start of a sewing operation. When the total stitch count equals certain predetermined stitch counts, the controller means commands the display feed means and label feed means to feed their respective material under a sewing head.

Variations in garment body dimensions often occur within a particular garment body size. For example, a garment neck edge can vary in length from garment to garment within a garment size by as much as plus or minus one inch (+/−1") resulting in an overall length variation of four inches (4"). The use of predetermined total stitch count values based on the start of the sewing operation to command display and label feeding can not account for the above described variations that exist within a garment size. As a result, inconsistent placement of display and label can occur.

Additionally, using a motor to drive the label feed means independently from, i.e. unsynchronized with, the motor driving the sewing head can cause the label to be misaligned when placed under the sewing head and cause the label to skew.

Further, feeding the collarette and display material on top of the garment body can obstruct the field of view of the sewing head, making it difficult for an operator to assure the sewing operation is being performed properly.

Finally, the layering of garment body, collarette, display, and label can complicate the automation of a subsequent operation necessary to sew the loose edge of the display over the overedge seam with a cover stitch. Specifically, automating the second sewing operation when the display and collarette is placed on top of the garment body would require an apparatus to be able to fold the display underneath the garment body and then to sew "blind" through the garment body and collarette. Such an apparatus would be difficult to construct and operate and would prevent the operator from being able to visually check whether the display has been folded and sewn properly in the second sewing operation until after the operation is complete.

Another partial solution to the above-identified problems is disclosed in Applicants' co-pending parent application, U.S. Patent Application U.S. Ser. No. 07/711,315, filed Jun. 6, 1991 for AN IMPROVED METHOD AND APPARATUS FOR AUTOMATICALLY ATTACHING A COLLARETTE, DISPLAY, AND LABEL TO A GARMENT BODY, commonly assigned to Sara Lee Corporation and Union Special Corporation, the joint assignees herein, the disclosure of which is hereby incorporated by reference herein. U.S. Ser. No. 07/711,315 discloses AN IMPROVED METHOD AND APPARATUS FOR AUTOMATICALLY ATTACHING A COLLARETTE, DISPLAY, AND LABEL TO A GARMENT BODY using, inter alia, a collarette feed means, display feed means, label feed means, a seam detector means, and a controller means. As disclosed, the placement of the collarette, display, and label is determined by detecting the presence of the garment body shoulder seam. As a result, the collarette, display, and label are accurately placed on a garment body. Additionally, feeding of the collarette and display is performed underneath the garment body allowing for a clear view of the sewing head and for simplifying the second sewing operation for sewing the display over the joining seam.

Both co-pending applications require manual feeding of the garment body through the sewing head. Manual feeding of the garment body would often yield an inconsistent finished product and require constant attending by the machine operator.

Additionally, in both co-pending applications, the garments removed from the sewing machine need to be taken by hand to a second sewing machine to perform the second sewing operation to sew the display over the joining seam. As a result, additional operation time, labor and floor space would be required to complete the second operation.

Further still, during the second sewing operation, an operator would need to manually fold the display over the joining seam to perform the second sewing operation.

Accordingly, there exists a need to automate the second sewing operation required after garments have been processed by the device disclosed, for example, in both co-pending applications.

It is therefore an object of the present invention to provide a method and apparatus for automatically attaching a collarette and other materials to a garment body.

Another object of the present invention is to provide a method and apparatus capable of attaching a collarette, display, and label to a garment body in an efficient and precise manner without the need of manual assistance to feed and maintain alignment of the materials during the sewing operation.

It is still a further object of the present invention to provide a method and apparatus capable of attaching a collarette, display, and label to a garment body such that the resulting product is of a consistently high quality, but manufactured using less time and manpower.

It is still a further object of the present invention to provide a method and apparatus for accurately placing and sewing a collarette, display and label onto a garment body, and to automatically align and fold the display over the overedge seam to stitch the display in place.

It is still a further object of the present invention to provide a method and apparatus for preventing a label from becoming skewed while being sewn to a garment body.

It is still another object of the present invention to provide a method and apparatus for feeding a collarette, display, and label to a sewing head without obstructing the field of view of a sewing head.

It is still a further object of the present invention to provide a method and apparatus for simplifying a second automated sewing operation for sewing the loose edge of the display over an overedge seam with a top stitch.

It is still a further object of the present invention to provide a method and apparatus for performing two sewing operations together to reduce operational time, labor, and floor space.

It is still a further object of the present invention to provide a method and apparatus for automatically folding the display on top of the joining seam to reduce labor and manufacture a consistently high quality product.

SUMMARY OF THE INVENTION

The above-described and other objects of the invention are met by providing an apparatus for attaching a collarette, display, and label to a garment body incorporating: a first sewing machine having a sewing head for sewing together the collarette, display, and label to a garment body to form a sewn assembly, a collarette feed means, a display feed means, a label feed means synchronized with the sewing head, a seam detector means, garment detector means, a stitch count means, a conveyor belt means to transport the sewn assembly from the first sewing machine to a second sewing machine having a sewing head for sewing the loose edge of the display over the seam sewn by the first sewing machine, a pair of unfolding mechanisms for folding the collarette and display from their first sewing position into position for the second sewing operation, and a controller means to control each device and perform necessary calculations.

In a preferred embodiment, an operator places a garment body on the sewing machine and presses a foot switch to activate same. If a garment is detected by the garment detector means, the sewing machine is activated and sewing starts. As the garment is being fed through the sewing machine, collarette material is stretched and automatically fed under the garment body by the collarette feed means allowing them to be sewn together by the sewing machine. Additionally, the controller means in combination with the stitch count means counts the total number of stitches (N) sewn.

When a first total stitch count ($N_1$) from the start of the sewing operation equals a predetermined stitch count for seam detection ($N_1=N_s$), the controller means commands the seam detector means to lower into the sewing area. When the garment body shoulder seam advances toward the sewing area, the seam detector means detects the presence of the shoulder seam. When the seam detector detects the presence of the shoulder seam, the controller commands the display feed means within a predetermined number of stitch counts to move into the sewing area and begin feeding the display material under the sewing head. By using the detection of the garment body shoulder seam to command the commencement of display feeding, accurate placement of the display material relative to the garment body is achieved.

After seam detection, the controller means maintains a second total stitch count ($N_2$) from seam detection and when the second total stitch count equals the number of stitches to count before inserting the label ($N_2=n_{sl}$), the controller means commands the label feed means to automatically feed a label to the sewing area. The label feed means is synchronized with the sewing head causing the label to be fed evenly under the sewing head, thereby preventing the label from skewing while being sewn to the garment body.

When the garment detector detects the end of the garment body, the controller means, after a predetermined number of stitches, commands the display feed means to move away from the sewing area and terminate the sewing of the display material. Finally, when the garment detector means fails to detect the presence of a garment, the sewing machine stops sewing after a predetermined number of stitches. The last predetermined stitch count controls the spacing of the garments being sewn through the apparatus of the present invention.

By using the detection of a garment body shoulder seam as a reference point for display and label feeding and maintaining a total stitch count during the sewing operation, the present invention is able to accurately determine the commencement and termination of the mechanical feeding of a display and label for the particular dimensions of such garment body being sewn. As a result, the present invention is able to achieve a consistently even manufactured product in less time using less manpower.

Additionally, by synchronizing label feeding with the overall sewing operation, the present invention is able to prevent label skewing.

By feeding the collarette and display material underneath the garment body during the sewing operation, the present invention allows an operator to have a clear field of view of the sewing head during the first sewing operation. Moreover, automation of the second sewing operation is simplified by enabling the display material to be folded from underneath to on top of the garment body to allow an operator a clear field of view during the second sewing operation.

After the first sewing operation, the sewn assembly of display, collarette, garment body and label are transported via upper and lower conveyor belt systems to a second sewing machine. There, the free, loose end of the display will be sewn in place with a top stitch so that the display extends over and covers the overedge seam, and preferably a top portion of the label.

Two unfolding mechanisms disposed along and in the path of the conveyor belt systems fold the display and collarette from underneath the garment body into position for the second sewing operation. The first unfolding mechanism unfolds the collarette approximately 180° to lay to the side of the overedge seam and flush with the body of the garment. At the same time, the display is unfolded approximately 180° to lay flush on top of the collarette, with its loose end located opposed and away from the overedge seam. After this operation, the sewn assembly proceeds to the second unfolding mechanism, where the display is lifted off of the collarette and folded approximately another 180°, so that the display lies flush on top of the garment body, with the loose end of the display overlying both the overedge seam and a portion of the label.

Following the unfolding operations, the presser foot of the second sewing machine is actuated to engage the sewn assembly, so that the loose end of the display is sewn with a top stitch to secure the display to the garment body and to cover the overedge seam. The sewn assembly is engaged by a rear puller roller assembly to urge the shown assembly through and away from the sewing head of the second sewing machine.

Subsequent to the second sewing operation, a sensor, programmed to detect a leading or trailing edge of the display, signals the presence of the trailing edge of the display. A fast action cutter assembly, mounted on a carriage, is actuated to cut the completed sewn assembly from other sewn assemblies still being processed. The garment body, with sewn collarette assembly, is thus ready for subsequent processing operations.

BRIEF DESCRIPTION OF THE DRAWINGS

The invention will be described in greater detail below by way of reference to the accompanying drawings, wherein:

FIG. 7 is a three dimensional view of a portion of the embodiment shown in FIGS. 4, 4A, 5 and 6.

FIG. 8A is a close-up side view of the seam detector;

FIG. 8B is a close up side view of a label deflector which may be employed with the device;

FIG. 9C is a rear planar view of the second unfolder;

FIGS. 9D and 9E illustrate sequential cross sectional views taken along lines A—A and B—B, respectively of FIG. 9C illustrating progressive unfolding of the display;

FIG. 9F is a closeup of the presser display adjacent the second unfolder;

DETAILED DESCRIPTION OF THE PREFERRED EMBODIMENTS

Figure 1:
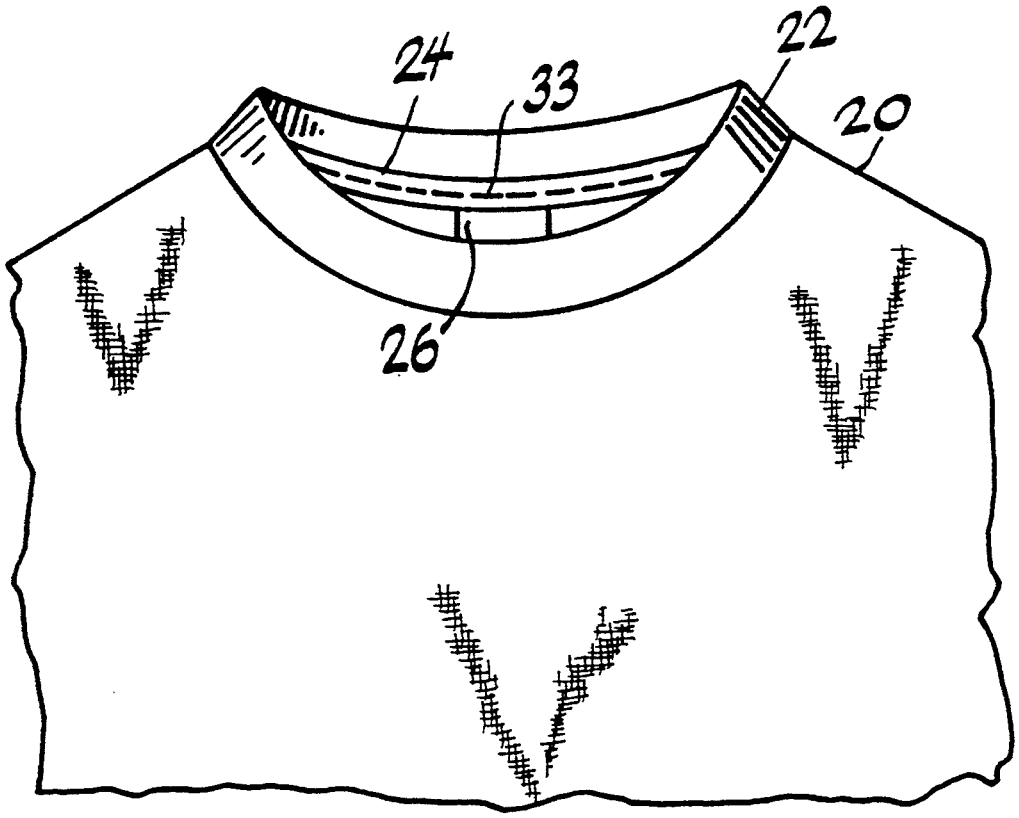
FIG. 1 is of a completed garment having a collarette, display, and label.

Referring to the drawings, in which like numerals denote like components, FIG. 1 is an illustration of the components of a completed garment having a collarette 22, display 24, and label 26 fashioned from known materials used for shirts, blouses, or the like. The dimensions of the various pieces are based on the desired size of the finished product. For example, in an average T-shirt, the width of collarette 22 is typically in the range of 13/16" to 17/16" and the width of display 24 is typically 7/16" to ½" wide. As will become readily apparent to those skilled in the art, the widths of the collarette and display can be easily varied.

Label 26, which provides the purchaser or wearer with information concerning the garment (e.g., size, manufacturer, washing instructions), may be made from various known materials such as nylon, cloth, or the like. The size of label 26 is usually dependent on the amount and the size of the writing present.

As shown in FIG. 1, display 24 and label 26 are affixed in a position such that display 24 covers the overedge seam which would be visible along the inside the garment neck when the garment is placed on its back. Also shown is top stitch 33 used in a second sewing operation to sew the loose end of the display over the overedge seam. Exemplary of such top stitch 33, as known to those skilled in the art, is a 401 SSa-1 chain stitch, a 301 SSa-1 lock stitch, or a 406 chain stitch.

Figure 2:
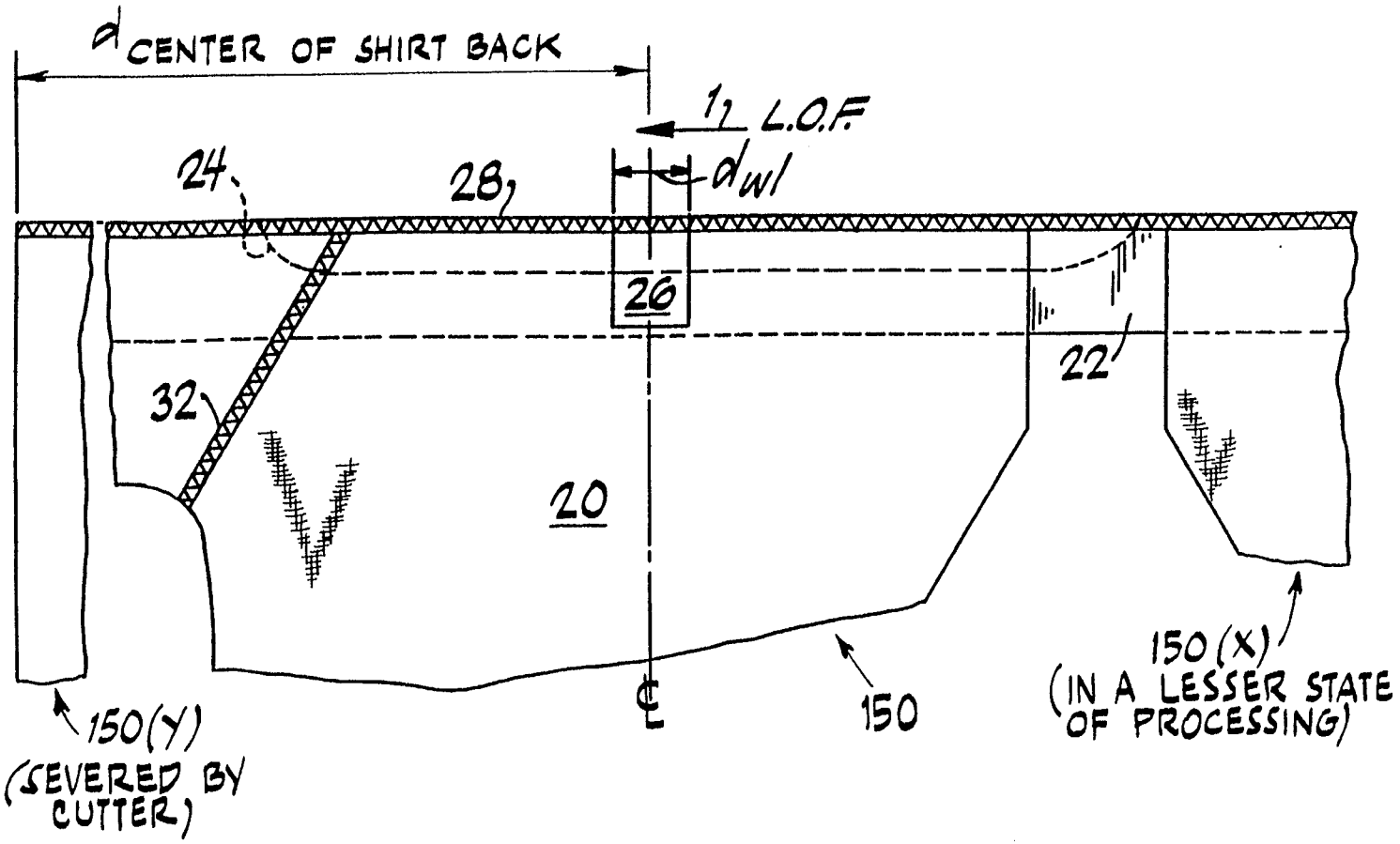
FIG. 2 is a planar view of the layered arrangement of a sewn assembly of garment body, collarette, display and label as they are sewn together using an overedge stitch.

FIG. 2 is a planar view illustration of a sewn assembly 150 illustrating the layering of display 24, collarette 22, garment body 20, and label 26 as fed through the apparatus of the present invention. As illustrated, the sewn assembly 150 is attached to other assemblies in lesser 150 (x) or greater 150 (y) states of processing in the system. As will be explained below, once processed by the present invention, each completed sewn assembly 150 will be severed from other, less complete sewn assemblies 150 (x) in the system in order to permit additional processing operations.

Referring to FIG. 2, the layering arrangement allows the display 24, collarette 22, garment body 20, and label 26 to be sewn together with a single overedge stitch. The overedge stitch, known in the art as a 504 SSa-1 stitch, forms an overedge seam 28. To assure proper placement of display 24, the display is preferably positioned so as to overlap shoulder seam 32 by approximately ¾" of an inch. As will become readily apparent to those skilled in the art, the overlap distance can be varied as desired. Line of feed ("L.O.F.") arrow 1 indicates the direction the display, collarette, garment body, and label are fed through the sewing apparatuses of the present invention.

Figure 3:
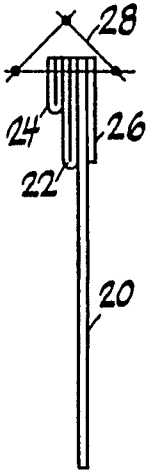
FIG. 3 is a side view of the layered arrangement of FIG. 2.

FIG. 3 is a side view illustration of the layering arrangement shown in FIG. 2 as the arrangement is fed through the sewing apparatuses of the present invention. The display 24 and collarette 22 are placed under garment body 20 and label 26 is placed on top of garment body 20. The layering of these materials as shown in FIG. 3 has several advantages. First, positioning the collarette and display material as illustrated allows them to be fed under the garment body. Accordingly, an operator is afforded a clear unobstructed view of the sewing head during a sewing operation. Additionally, the layering of the display 24 and collarette 22 underneath the garment body simplifies the automation of the second sewing operation, wherein the loose end of the display is sewn over the overedge seam 28 with top stitch 33. Specifically, the display material can be folded from under the garment body 20 to the top thereof, allowing a second sewing operation to be performed.

Figure 11:
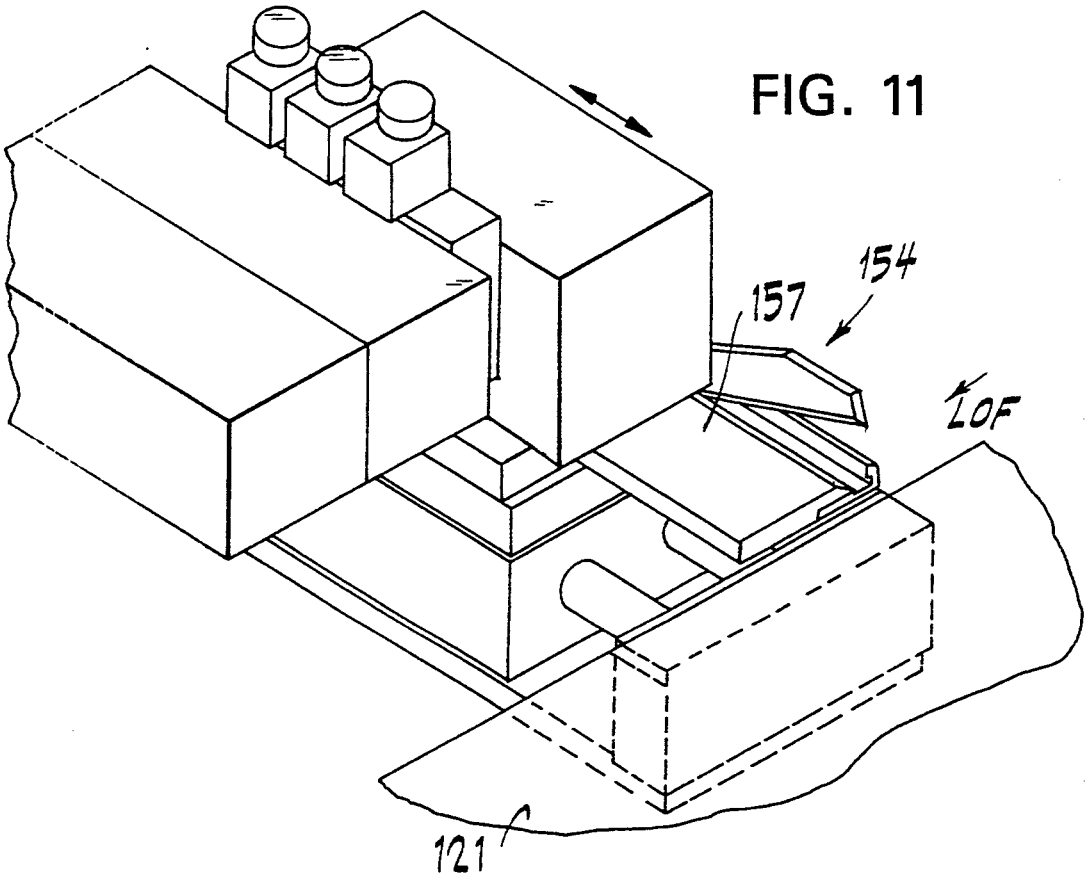
FIG. 11 is a planar view of the fast action cutter with its carriage assembly.
Figure 9A:
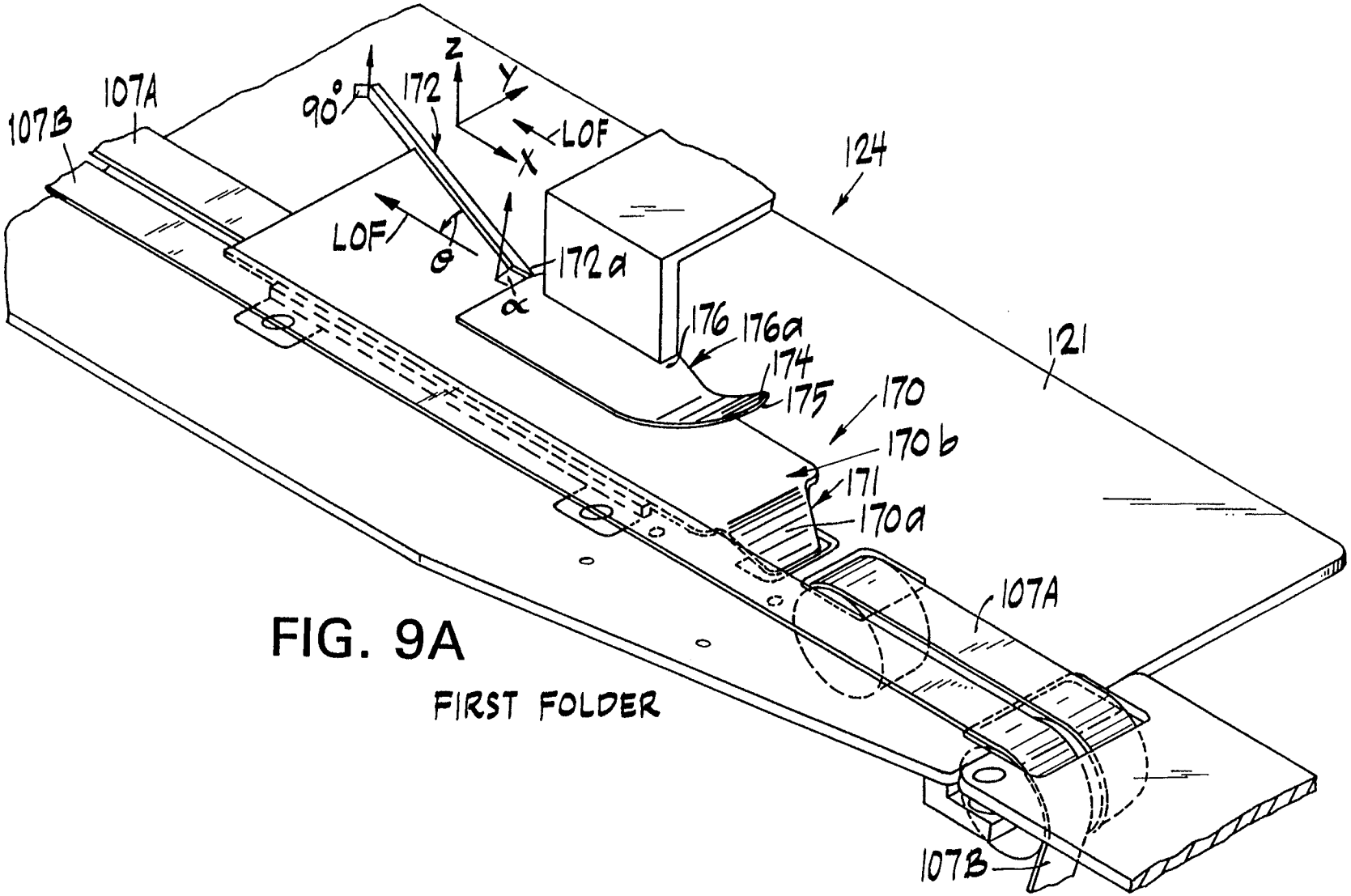
FIGS. 9A and 9B are close up planar views of the first and second unfolder mechanisms according to an embodiment of the present invention.
Figure 9B:
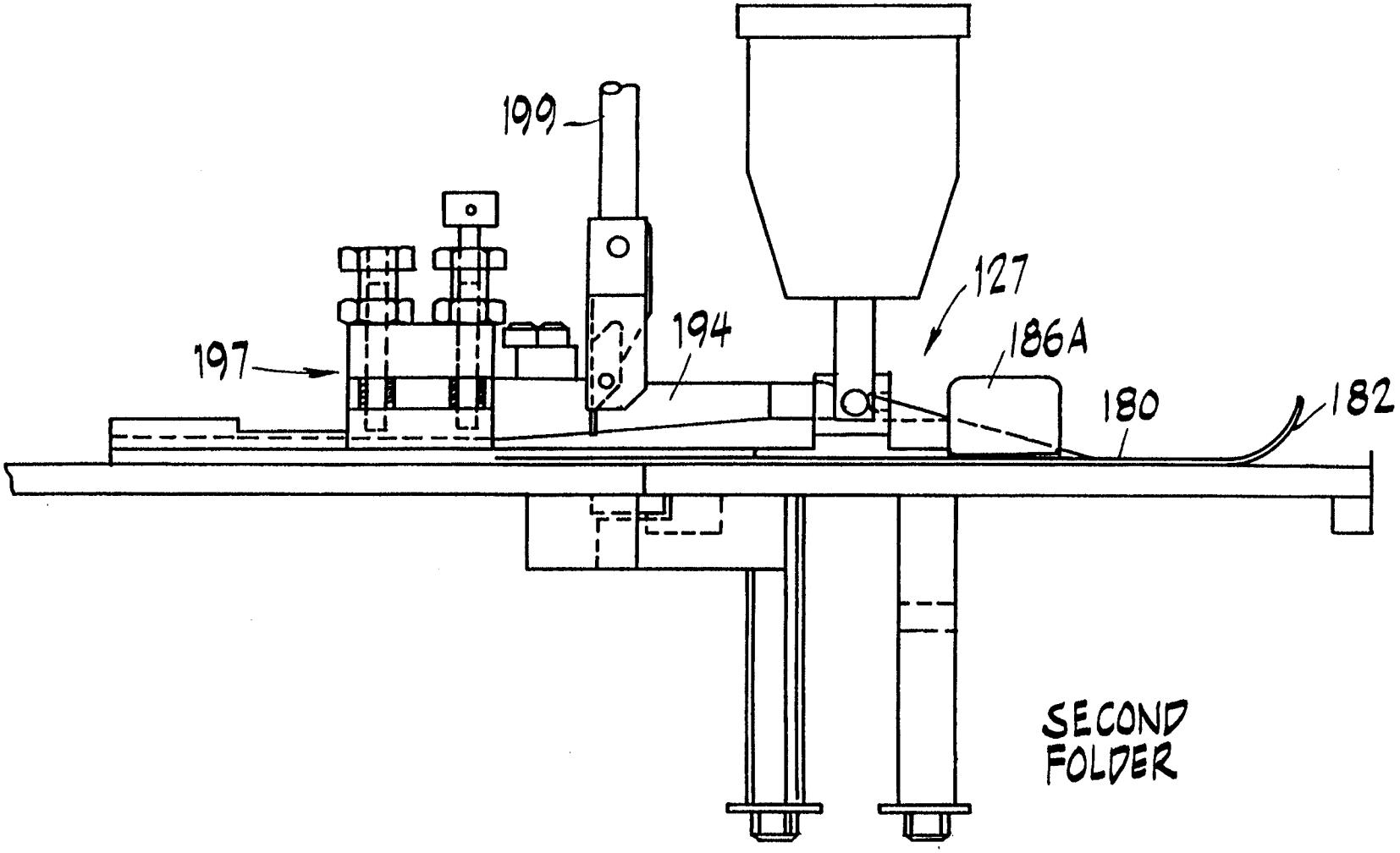
Figure 10:
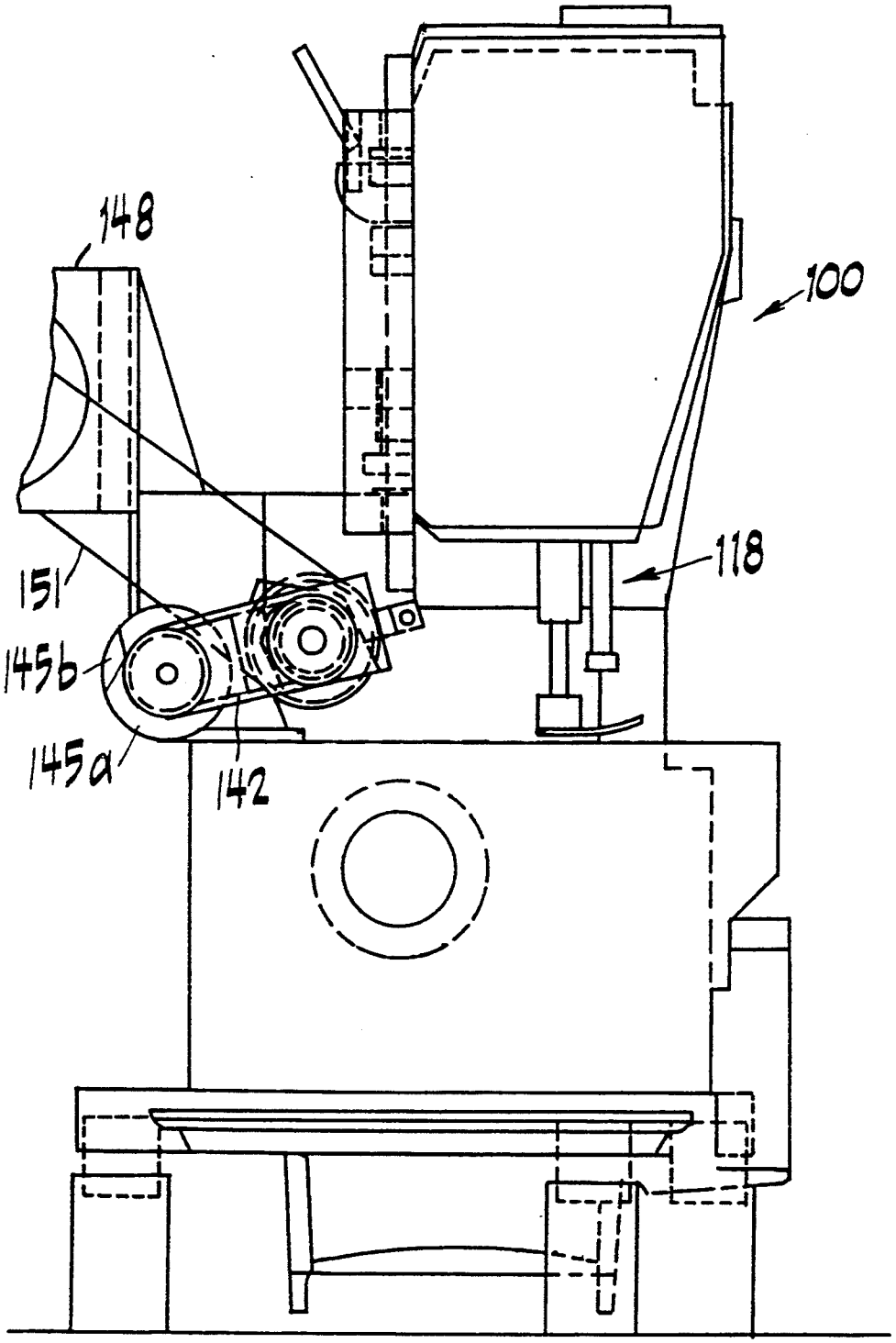
FIG. 10 is a close-up of the second sewing machine with the rear puller assembly according to an embodiment of the present invention.

A preferred embodiment of the present invention is illustrated in the side, top, and front views of FIGS. 4, 4A–4E, 5, and 6 respectively, as well as the three dimensional view of FIG. 7 and the close-up side views of FIG. 8A. FIG. 8B is directed to an optional label deflector. FIGS. 9A–9F are directed to the first and second unfolding mechanisms and presser display while FIG. 10 illustrates a second sewing machine and rear puller assembly according to a preferred embodiment of the present invention. FIG. 11 illustrates the fast action cutter and carriage, while FIGS. 12A and B illustrate component placement and sequencing at various stages during processing of the garment. FIGS. 13A–13D are a flow chart illustrating overall operation of the device.

Frame 34 is used to support the various elements of the present invention. Controller 36, having a control panel 37, is attached to the front of frame 34 as shown. In the preferred embodiment, a Union Special C.P.U. design is used as controller 36. Control panel 37 is used to allow an operator to input to the controller certain predetermined garment parameters such as size and style (e.g., distance to shoulder seam, label width, overlap distance, and the like). Motor 38 is used to drive first sewing machine 39 having a sewing head 40. In a preferred embodiment, a 39500 series sewing machine, manufactured by Union Special of Huntley, Ill., is used. Stitch counter 90 is used to count each revolution, which represents one stitch of sewing head 40 and signals same to controller 36 which maintains a total stitch count for each sewing operation.

Rolls 56, 58 and 60 are used to provide a continuous supply of collarette 22, label 26, and display material 24 respectively. As will become readily apparent to those skilled in the art, the supply of these materials may be from flat continuous strips of folded material, commonly called festooning. The size and dimension of supply rolls 56, 58 and 60 are dependent on the materials used. Additionally, thread supply spools 102, 104 and 106 are used to supply thread to sewing head 40 in a known manner. Each of the rolls of festooning (56, 58, 60) which supply collarette material 22, display 24, and label 26, along with the thread supply spools (102, 104, 106), are provided with respective sensors (56*a*, 58*a*, 60*a*, 102*a*, 104*a*, 106*a*) linked to the controller 36 which relay signals to the operator (via display panel 37) when the respective supplies of festooning or thread have been exhausted from the rolls or spools.

Collarette feed motor 62 drives collarette feed rollers 63 which are used to maintain the collarette in tension between the rollers 63 and the sewing head 40. The tension created effectively stretches the collarette material as it is being sewn to the garment body so that the completed garment and collarette will lie flat and have no wrinkles or gathers around the neck when worn. As shown, the collarette material is fed underneath the garment body. Accordingly, when an operator sews the collarette to the garment body, the operator is afforded a clear unobstructed view of the sewing head 40.

Display feeder 65 is used to fold the display material and to guide same into the sewing area so as feed the display material 24 underneath collarette material 22 and under presser foot 80 and sewing head 40. The resulting adhesion between the collarette 22 and the display 24 while under sewing head 40 causes the display material to unroll from display supply roll 60 and feed under the sewing head 40. Pneumatic display feed inserter 64 is used to move display feeder 65 into and out of the sewing area on command from the controller 36. As with the feeding of the collarette material, the display material is fed under the garment body allowing an operator to have an unobstructed view of the sewing head 40 during the sewing operation. Plate 67 is used to help guide the collarette material over the display feeder 65 and under presser foot 80.

Label feeder 70 is used to cut labels from supply roll 58 and feed same to sewing head 40. The label feeder comprises a stepper motor to drive label arm 72, a pneumatic gripper 74 for gripping a label 26, and a hot knife 76 for cutting labels from the label supply roll 58. On command from controller 36, the label arm 72 and gripper 74 grab a label 26 from the hot knife 76 and deliver same under presser foot 80 to sewing head 40. The label feeder stepper motor 71 is synchronized with the motor 38 driving sewing head 40 so as to synchronize the label feeding operation with the overall sewing operation. Synchronizing the label feeding with the sewing head allows the gripper 74 to hold on to the label as it is being sewn to the garment body 20 under sewing head 40, effectively preventing the label from skewing during the sewing operation.

As shown in detail in FIG. 8B, the device may optionally include a pneumatic label guide 78 to supplement the action of the label arm 72 to guide the label under the presser foot 80 and sewing head 40. If employed, on command from the controller 36, the label guide 78 lowers into the sewing area to be in alignment with the label feeder to help guide each label under presser foot 80 and sewing head 40. In either case, as illustrated, feed dogs 92 of the first sewing machine 39 serve to feed the material through sewing head 40 during the sewing operation.

A garment detector 82, comprising, for example, a light emitting diode ("LED") and a photodetector, is used to detect the presence of a garment body in the sewing area. Specifically, light from the LED is directed downward to the sewing area and reflected back to the photodetector by reflective patch 94. When a garment is placed in the sewing area and on top of the reflecting patch 94, the light being reflected from the LED is blocked and therefore not detected by the photodetector causing the garment detector to signal to the control means a "garment present" signal. As will become readily apparent to those skilled in the art, a through-beam photodetector can also be used as a garment detector.

As illustrated in FIG. 8A, a mechanical seam detector 83, comprising, for example, a spring loaded paddle 83*a* pivotally affixed near a proximity switch 83*b*, is used to detect garment body shoulder seam 32 during the sewing operation. In a preferred embodiment, upon command of controller 36, the detector 83 is lowered into the sewing area. The paddle 83*a* is positioned above the sewing area to allow garment body 20 to pass beneath but to physically block passage of shoulder seam 32. As shoulder seam 32 passes beneath the paddle 83*a*, the paddle is deflected against spring 79, thus causing the paddle to pivot away from proximity switch 83*b*. The proximity switch then relays a signal to controller 36 to indicate that shoulder seam 32 has been detected. Because the paddle 83*a* is biased by the spring 79, the seam detector 83 is able to avoid false triggering by wrinkles or folds characteristic of soft cloth garments which lack the rigidity of shoulder seam 32 and are thus unable to cause paddle 83*a* to pivot away from the proximity switch 83*b*.

In the preferred embodiment, all motors and sensors are digital devices. Nevertheless, as will become readily apparent to those skilled in the art, analog devices can be used.

Once a device is configured as described above, the first sewing operation of the present invention can be performed. An operator feeds the collarette and display material through their respective feed mechanisms to effectively prime the apparatus for commencement of a sewing operation. The operator then activates the controller via the control panel to start a sewing operation for sewing collarette, display and label to the garment body.

Referring to FIGS. 4, 4A–E and 5, once the sewn assembly 150 of the garment body 20, collarette 22, display 24 and label 26 have been attached by first sewing machine 39, the assembly may be transported to second sewing machine 100 having a sewing head 118 for sewing top stitch 33 onto the loose end of display 24, thereby securing the display 24 over the overedge seam 28 and a portion of label 26.

Figure 4:
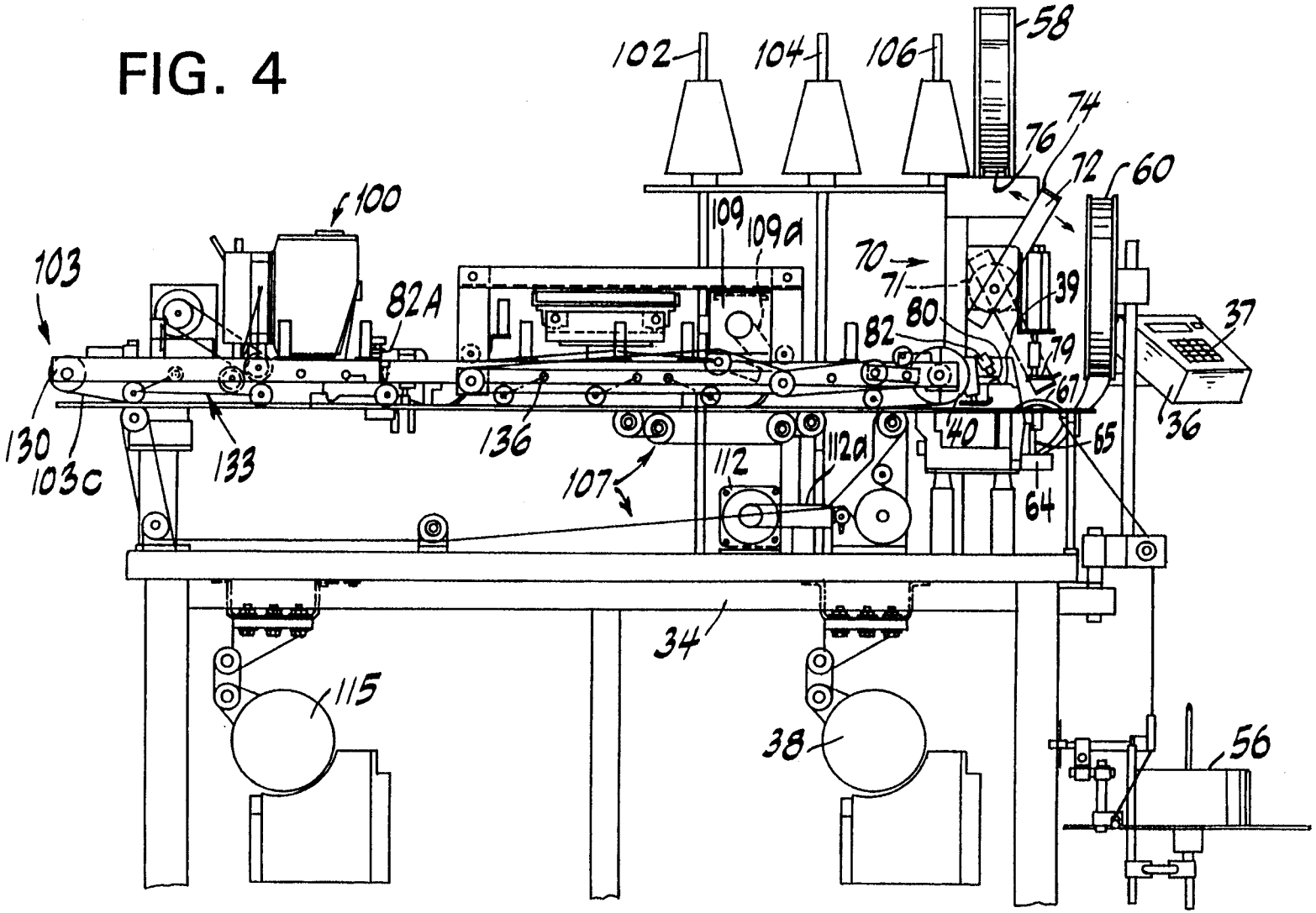
FIG. 4 is a left side view of an embodiment according to the present invention, illustrating the first and second sewing machines, the conveyor systems the unfolded mechanisms, and the cutter assembly.
Figure 4A:
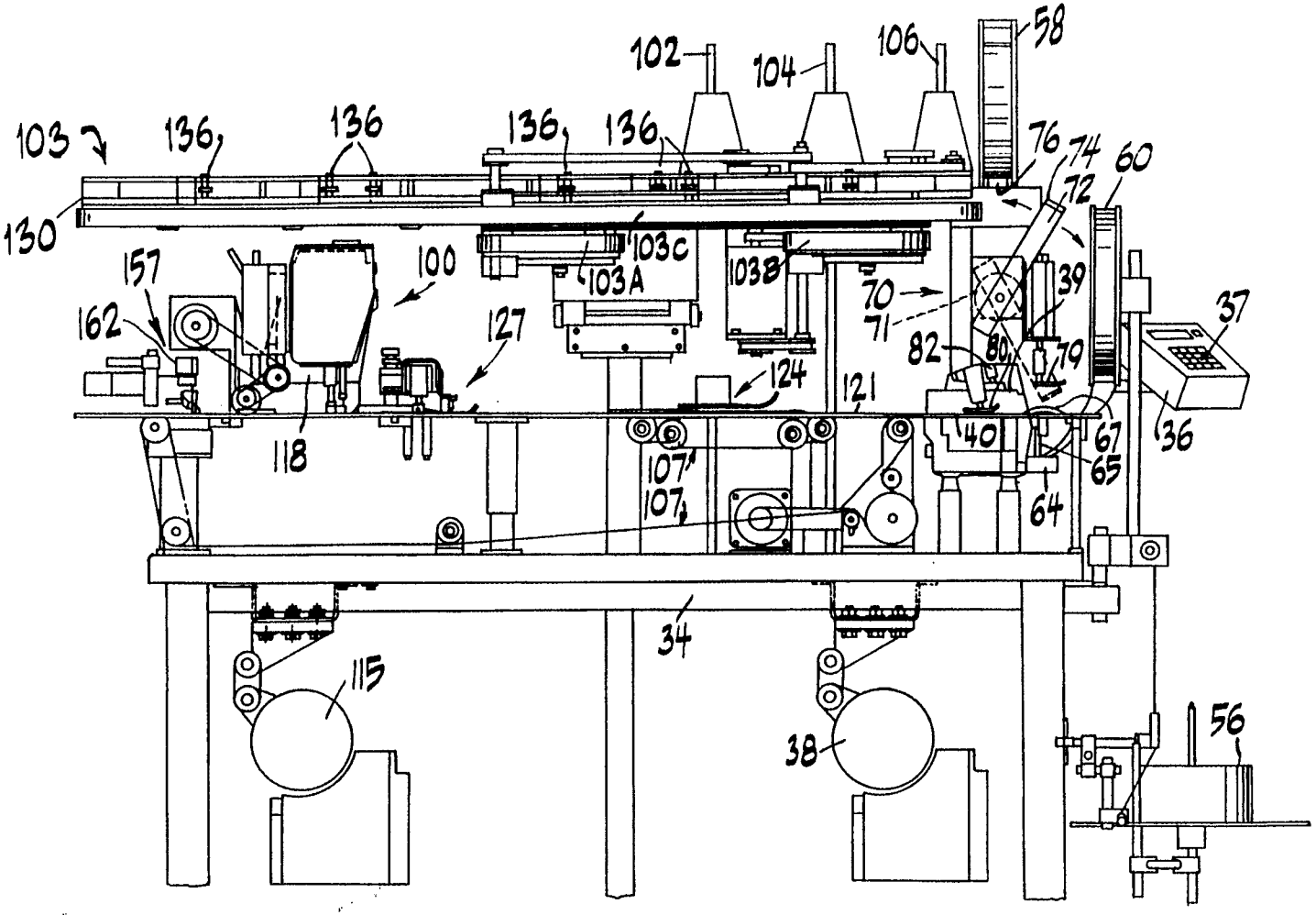
FIG. 4A is a left side view of the embodiment of FIG. 4 with the upper conveyor system in its swing out service positions.
Figure 5:
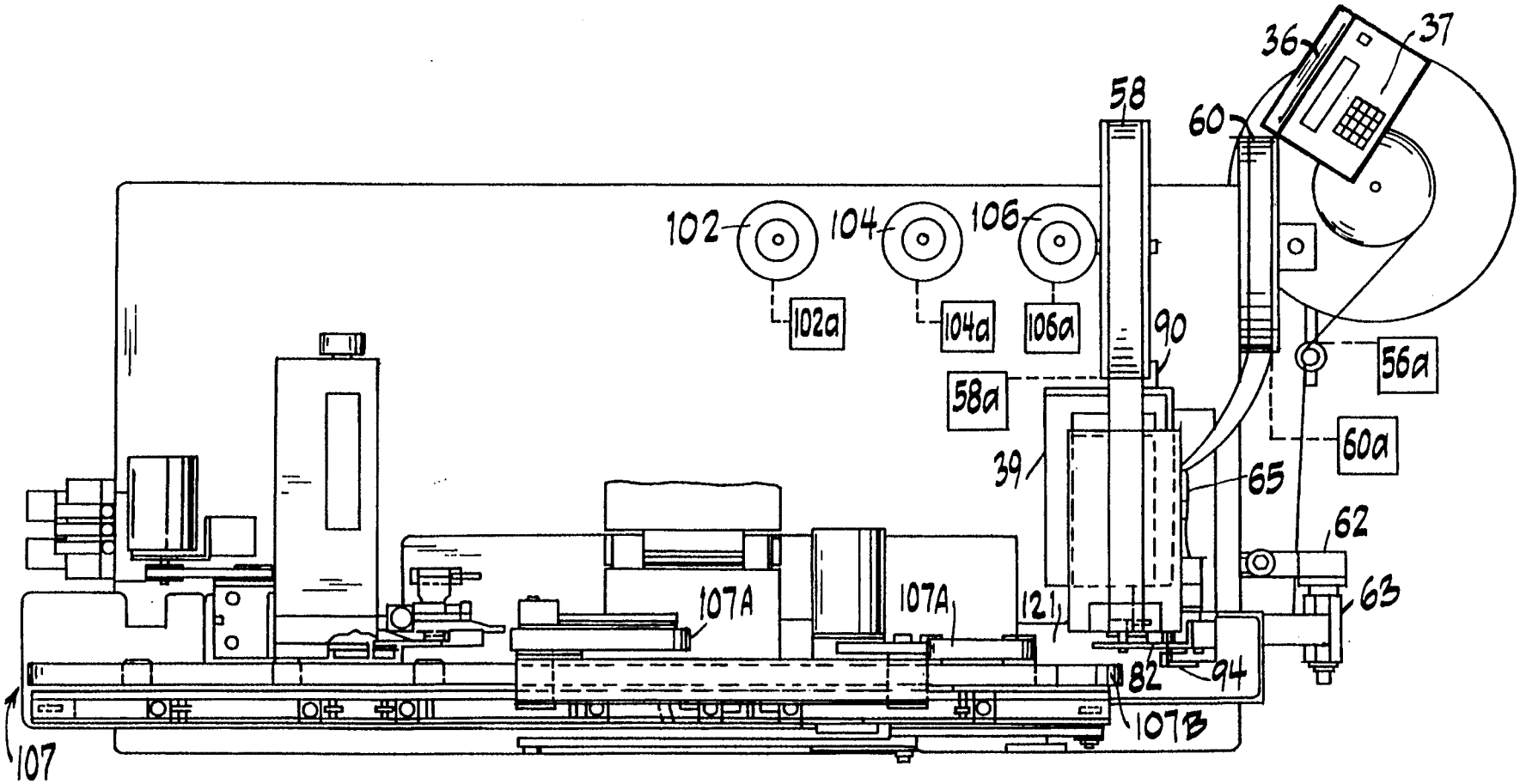
FIG. 5 is a top view of the embodiment of FIG. 4.
Figure 6:
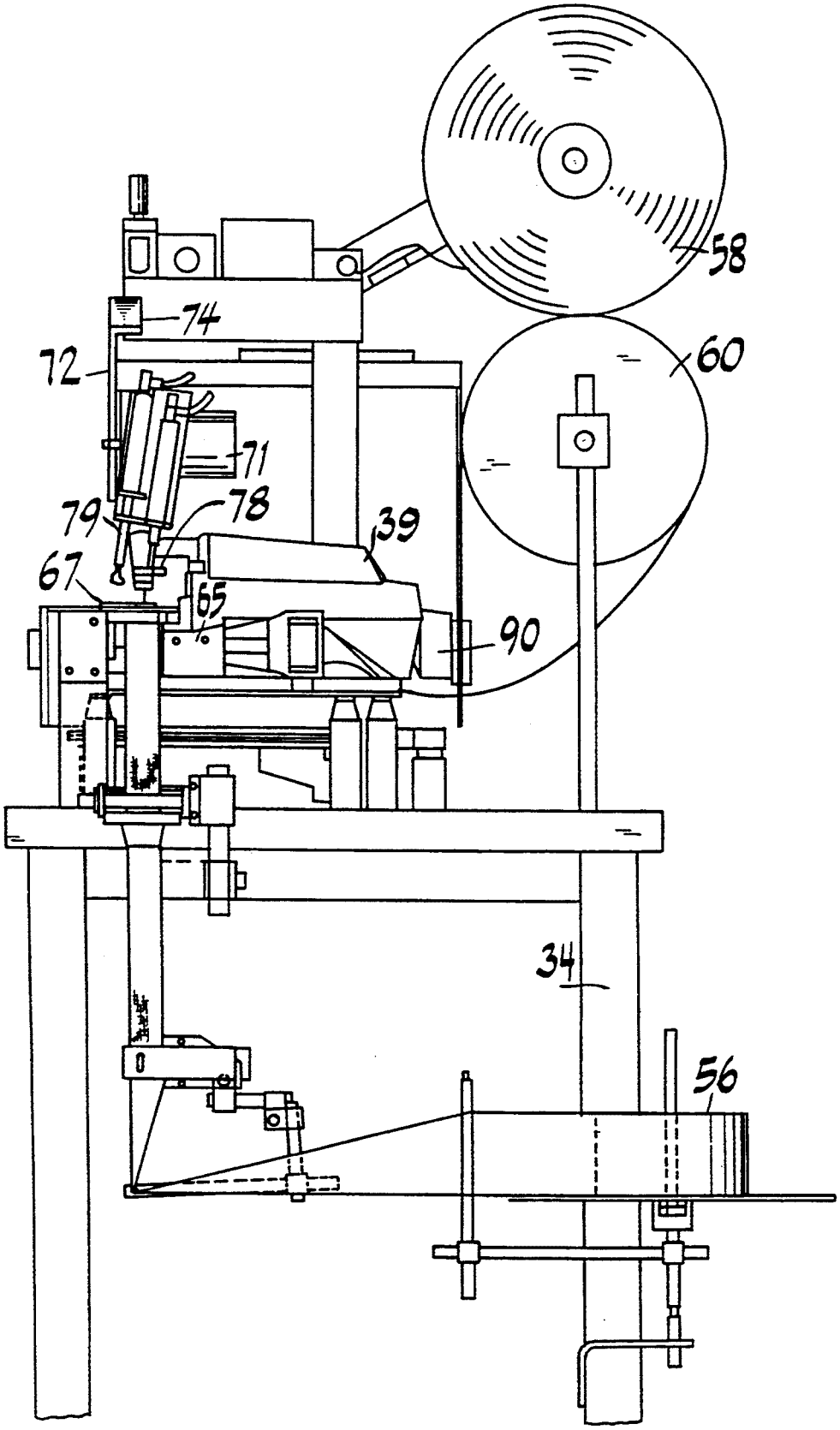
FIG. 6 is a front view of the embodiment of FIG. 4.

Referring to FIGS. 4, 4A and 5, the sewn assembly 150 is transported along workpiece platform 121 via an upper belt system 103 having a plurality of upper conveyer belts 103*a*, 103*b*, and 103*c*, and a lower belt system 107 having a plurality of lower conveyor belts 107*a*, 107*b*. As shown, both the upper and lower belt systems include long continuous outside belts 103*c*, 107*b* that extend lengthwise from the sewing head 40 of the first sewing machine 39 to the sewing head 118 of the second sewing machine 100. Both the upper belt system 103 and lower belt system 107 are driven and actuated by respective D.C. stepper motors 109, 112, such as manufactured by Superior, via respective belt drive systems 109*a*, 112*a*. By employing controller 36, stepper motors 109, 112 may be synchronized with motors 39 and 115 driving the sewing heads 40 and 118 to coordinate operation of the system.

Referring to FIGS. 4, 4A, 4B and 5, the upper conveyor system includes three upper conveyor belts 103*a*, 103*b* and 103*c*, with two inside short belts 103*a*, 103*b* and, as described, a long continuous outside belt 103*c*. As shown, the lower conveyor system 107 includes, as described, a long continuous outside belt 107*b*, and a second inside conveyor belt 107*a*. Referring to FIGS. 4A and 9A, the lower inside conveyor belt 107*a* is configured to run on a work piece platform 121 from the first sewing head 40 to an area in the proximity of first unfolding mechanism 124. Thereafter, lower inside conveyor belt 107*a* is threaded underneath the work piece platform 121 and extends beneath the length of the first unfolding mechanism 124. The lower inside conveyor belt 107*a* is then threaded back onto the surface of the work piece platform 121 to extend thereon to run to the onset of the second unfolder 127.

As configured, providing upper and lower conveyor systems 103, 107 eliminates or negates any drag effects which could cause wrinkles, puckering or misalignment of the sewn assembly. Additionally, even and positive drive is facilitated for the entire sewn assembly, by providing outside conveyor belts 103*c*, 107*b*, which act primarily upon garment body 20, while the upper inside conveyor belts 103*a*, 103*b*, together with the lower inside conveyor belt 107*a*, act primarily on the collar 22/display 24.

Advantageously, the upper belt system 103 is mounted on a swing out assembly 130 which is rotatably affixed to the frame 34 supporting the device. The swing out assembly 130 allows the upper conveyor system 103 to be rotatively positioned between an upper service position away from engagement with the lower conveyor system 107 (as shown in FIG. 4A), and a lower engagement position (as shown in FIG. 4) wherein the upper belt system 103 is in engagement with and in operative contact with the lower belt system 107. The upper service position allows ready access to the conveyor systems and other components on workpiece platform 121. When in the operative position, shorter length conveyor belts 103*a*, 103*b* of upper belt system 103 engage with the inside conveyor belt 107*a* of lower conveyor system 107. Similarly, the outside continuous upper conveyor belt 103*c* engages with the long continuous conveyor belt 107*b* of the lower belt system 107. Once the upper conveyor belt system 103 is rotated via its swing out assembly 130 into operative position and secured thereto by the operator, the upper conveyor system 103 is engaged with the lower conveyor system 107, thereby pressing the sewn assembly 150 therebetween to urge and transport the sewn assembly 150 to the second sewing machine 100.

As seen in FIGS. 4 and 4A, 4C–4E, the upper conveyor system 103 features a plurality of compliance rollers 133, pivotally affixed to the swing out assembly 131, which are engageable with the inside surface of the outside upper conveyor belt 103*c*. The compliance rollers 133, each individually connected to a linkage assembly 136A affixed to assembly 130 and actuated by air cylinders 136 activated by the operator of the device, are lowered into engagement with the inside surface of the outside upper conveyor belt 103C once the swing out assembly 130 is rotated into its operative position. The compliance rollers 133 assist the outside upper conveyor belt 103*c* to more firmly press against the outside lower conveyor belt 107*b*, thereby assuring positive drive and transport of the sewn assembly 150, and negating any adverse effects of ripples or wrinkles which may appear in the soft cloth that forms the sewn assembly 150.

Referring to FIGS. 4, 4A, 4B, 9A–9F and 11, the sewn assembly 150 is transported by the conveyor belt systems 103, 107 along work piece platform 121 past a first unfolding mechanism 124 and a second unfolding mechanism 127. The first unfolding mechanism 124 serves to reorient the position of collarette 22 and display 24 by unfolding collarette and display approximately 180° outward from underneath the sewn assembly 150. The second unfolding mechanism 127 then folds the display another 180° over the overedge seam 28 into its final position for processing by second sewing machine 100.

As illustrated, the first unfolding mechanism 124 rotates the unsewn loose ends of the collarette 22 and display 24 from underneath the sewn assembly 150; the collarette 22 lays flush with and to the side of the garment body 20, while the display 24 is repositioned to rest on top of the collarette 22. In general, the first unfolder 124 includes a collarette unfolder 170 and a seam guide 174. The collarette unfolder includes a ramp portion 170*a* angled upwards from the surface of work piece platform 121 to merge with a horizontal plate portion 170*b*, slightly raised from the surface of work piece platform 121, that includes an engaging edge 171.

An upraised edge section 172 is formed at the opposite end of unfolder 170. As illustrated, the upraised edge section 172 forms an acute angle with respect to the line of feed (LOF) in the plane of work piece platform 121, and is gradually, angularly, tapered along its length from an acute angle (with respect to the vertical of the work piece platform 121) at the leading end 172*a* of the upraised edge section to a vertical configuration at the trailing end 172*b*.

The seam guide 174 includes an up-angled end portion 175 which gradually curves to a horizontal plate portion 176 that is mounted to provide a slight clearance between the seam guide 174 and the collarette unfolder 170. The horizontal plate portion 176 includes a seam engaging edge 176*a*.

Figure 12A:
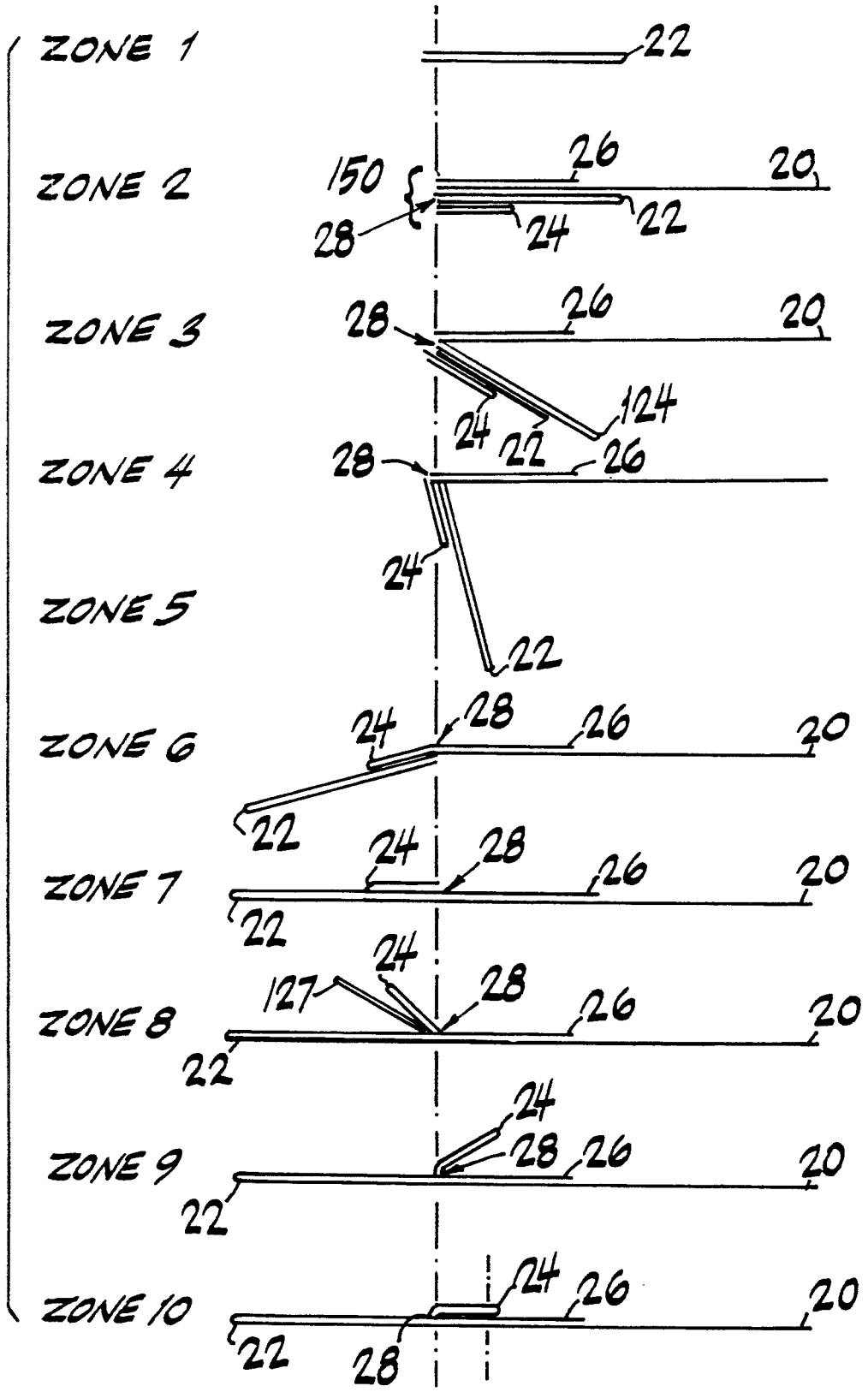
FIG. 12A is a schematic view of the placement and unfolding operations of the sewn garment components during processing.
Figure 12B:
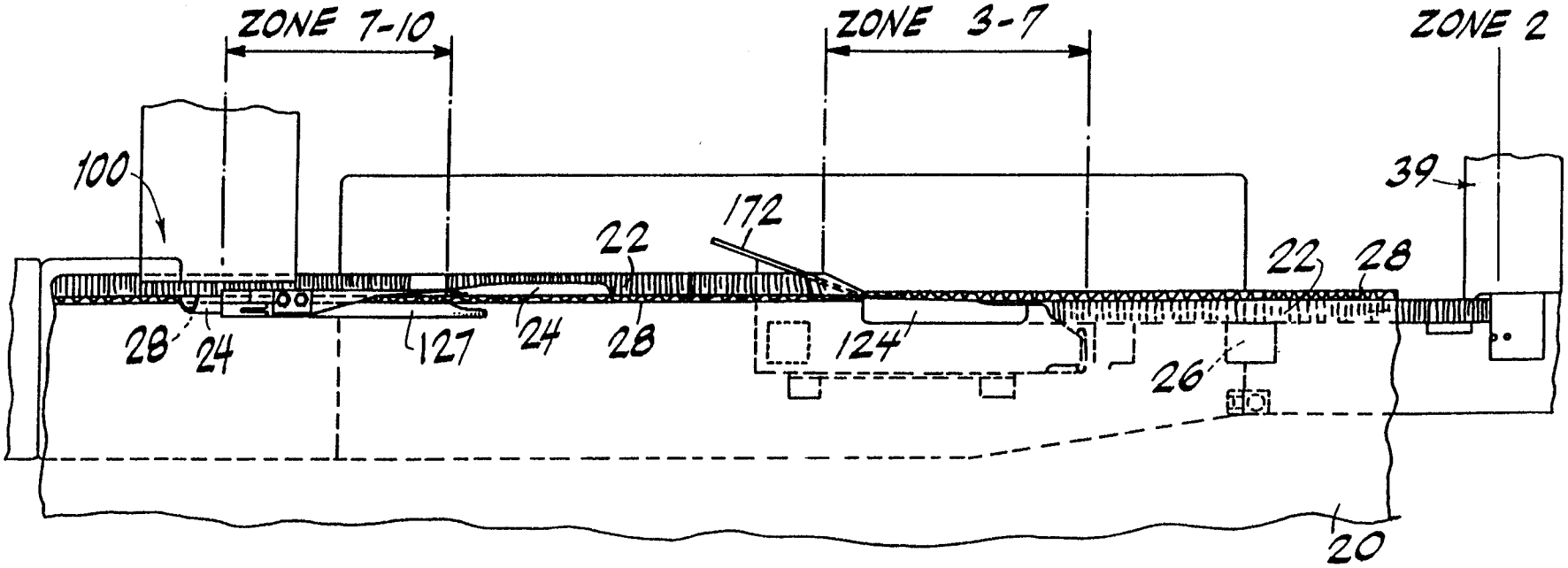
FIG. 12B is an overhead view illustrating the placement and unfolding operations and the relationship of the components schematically represented in FIG. 12A.

Referring to FIGS. 4A, 9A and 12B, in operation, as the sewn assembly 150 is transported towards the first unfolder 124 and proceeds up ramp portion 170*a*, the engaging edge 171 (disposed along the length of ramp portion 170*a*/horizontal plate portion 170*b*) is wedged between collarette 22 and garment body 20. Because the horizontal plate portion 170*b* is spaced from the surface of work piece platform 121, the collarette 22 and display 24 will travel beneath the plate portion 170*b*, while the garment body 20 and label 26 will be positioned atop the plate portion 170*b*. As the sewn assembly 150 continues its travel along the line of feed, it will pass beneath the seam guide 174. The up-angled end portion 175 assures smooth transition of the sewn assembly as it enters the seam guide. The seam engaging edge 176*a* will engage the overedge seam 28 of the sewn assembly 150 to provide and maintain alignment of the sewn assembly. The clearance between the horizontal plate portion 176 of the seam guide and the horizontal plate portion 170*b* of the collarette unfolder 170 provides unimpeded passage of the garment body 20/label 26.

As the sewn assembly approaches the far end of the seam guide 174, the upraised edge section 172 of the collarette unfolder encounters the collarette 22 and display 24. While the garment body is being positively urged by the upper and lower outside conveyor belts 103*c*, 107*b*, the upraised edge section 172 of unfolder 170 forces the collarette 22 and display 24 from beneath the horizontal plate portion 170*b* of the unfolded (and, consequently, from beneath the garment body 20) and rotates these components 180°. The collarette 22/display 24 thus come to rest atop the horizontal plate portion 170*b*. The collarette 22 and display 24 have now been unfolded 180° from their original position during processing at the first sewing machine 39, and rest to the side of overedge seam 28 in the same plane as garment body 20. The components are thus oriented to allow the display 24 to be maneuvered into its final position before sewing of top stitch 33.

After processing by the first unfolding mechanism 124, the sewn assembly 150 is transported to a second unfolding mechanism 127. Here, the display 24 is lifted off of collarette 22 and folded another 180° so that the loose edge of display 24 travels over the overedge seam 28 and a portion of label 26. The display is thereby positioned so that the second sewing machine 100 may sew a top stitch 33 to secure the display 24 over the overedge seam 28 and the label 26.

As illustrated in FIGS. 4A, 9B, 9C, 9D and 9E, second unfolding mechanism 127 includes a seam guide 180, having an upturned leading end 182 and a seam engaging edge portion 184. A reflective display present sensor 186 comprising, for example, a Banner SE612LV, is mounted out of the garment processing area, and is pointed to a display target 186A mounted along the seam engaging portion 184. The display target 186A is covered, for example, with a reflective tape, such as Banner BR-T-100, to reflect the beam of the display present sensor 186. A second shoulder seam detector 199, which may be configured similar to shoulder seam detector 83 previously described, is also provided.

The unfolding mechanism 127 further includes a display unfolder 188, spaced away from and parallel to the seam guide 180, for folding the display 24 over the overedge seam 28. As illustrated, the display folder 188 includes a ramp portion 190 elevated from the surface of work piece platform 121 merged to a horizontal platform portion 192 likewise elevated from the work piece platform 121. An vertical walled edge portion 194, forming an acute angle λ with the line of feed on work piece platform 121, projects from horizontal platform portion 192. Jutting outward from the vertical walled portion 194 is a tapered tunnel portion 194A which is progressively angled downward toward workpiece platform 121.

Referring to FIGS. 9C and 9F, a spring-loaded presser display 196, having a work piece engaging platform 197 formed with a lengthwise channel 198 formed therethrough, is mounted after the display folder lee along the line of feed and just before second sewing head 118 of second sewing machine 100.

In operation, as the sewn assembly travels past seam guide 180, the upturned leading end 182 facilitates smooth engagement of the overedge seam 28 along the seam engaging edge portion 184. By engaging against overedge seam 28, the seam engaging edge portion 184 assures alignment of the sewn assembly 150 during the display folding operation. The display present sensor 186 detects the onset of the folding of display 24 over overedge seam 28 (the display 24 breaking the reflective beam of the sensor 186) and relays a signal to the controller 36. This provides a sensing window allowing second shoulder seam sensor 199 to descend at an appropriate time to detect the garment shoulder seam 32 in preparation for the subsequent sewing of seam 33 by the second sewing machine 100.

As illustrated in FIG. 12B, the collarette 22 passes beneath the ramp portion 190 of the display folder 188. However, the display itself is engaged by ramp portion 190 and proceeds to engage the vertical walled edge portion 194. The display is thus forced vertically upward from atop the collarette 22. As the sewn assembly continues its movement, because the vertical walled edge portion 194 angles away from the line of feed, the display is forced to unfold from atop the collarette and about the overedge seam 28. The display 24 will be vertically inclined until it engages the tapered tunnel portion 194A, which causes the display to further fold about the overedge seam 28. The continued movement of the sewn assembly, together with the downward angle of the tunnel portion 194A, forces the display to fold about and down over the overedge seam 28.

As the sewn assembly 150 continues to move toward the second sewing machine 100, the display 24 passes beneath presser display 196. As previously described, the presser display is spring loaded, so that the engaging platform 197 maintains uniform pressure on the display 24 against garment body 20, preventing puckering of the components and ensuring that the display will be evenly stitched by the second sewing machine 100. Just after the display 24 has been folded over by the tapered tunnel portion 194A of second unfolder 127, the overedge seam 28 passes within and is guided through the channel 198, further promoting alignment of the sewn assembly as it is being processed by the second sewing machine 100.

FIGS. 4, 4A and 10 illustrate the second sewing machine 100, having a sewing head 118 for sewing the top stitch 33 onto the sewn assembly 150. The second sewing machine 100 may entail, for example, a Model 600 manufactured by Union Special Corporation, with the sewing head 118 sewing a 406 chain stitch onto the display 24. The sewing head 118 of the second sewing machine 100 is driven through a belt drive (not shown) by a DC servo motor 115 such as manufactured by EFKA. The motor is controlled by system controller 36 and is synchronized with the motor 38 driving first sewing head 40.

The second sewing operation is actuated when garment body shoulder seam 32 has been detected by second shoulder seam sensor 199. As previously noted, the second shoulder seam sensor 199 may be a mechanical or a through-beam type sensor, similar to the detector 83 located at the first sewing machine 39. After a predetermined time or stitch count after shoulder seam 32 has triggered sensor 199, presser foot 139 of second sewing machine 100 is lowered to engage the sewn assembly 150. Sewing head 118 of second sewing machine 100 then begins to apply top stitch 33 to the sewn assembly 150. When the sewn assembly 150 includes a display 24, the second sewing operation will not commence until the presence of display 24 has been detected by a display present sensor 186.

FIG. 10 also illustrates a rear puller assembly 142, which engages the sewn assembly against the work piece platform 121 to urge the sewn assembly 150 through the second sewing machine 100 during the sewing operation. The rear puller assembly 142 helps assure positive drive of sewn assembly 150 by assisting the conveyor systems 103, 107, as well as the feed dogs (not shown) of the second sewing machine 100, to stretch the collarette 22/display 24 and maintain them aligned during the second sewing operation. Preferably the conveyor belt systems 103, 107, and rear puller assembly 142 are synchronized with operation of the first and second sewing heads 40, 118 to ensure smooth, accurate and synchronized processing of various of the sewn assemblies 150 located in each phase of the device.

The rear puller assembly 142 features a pair of opposed rollers 145*a*, 145*b* which are driven at the same speed by a stepper motor 148 through a belt drive assembly 150. The rollers 145*a*, 145*b* are lowered to engage the sewn assembly 150 against the work piece platform 121. Advantageously, the rollers 145*a*, 145*b* are individually, pivotally affixed to the rear puller assembly 142 to allow each roller 145*a*, 145*b*, to "float" independently above the surface of work piece platform 121. Each roller 145*a*, 145*b* is thus able to accommodate the varied number of the plies of material that may be present under each of rollers 145*a*, 145*b*, assuring positive drive for the sewn work piece 150.

The second sewing operation continues for a predetermined time or stitch count after the lowering of presser foot 139. The second sewing operation usually lasts until the entire loose edge of the display 24 is attached to the garment body 20. When the second sewing operation is completed, a thread cutter (not shown) cuts the thread. Just as presser foot 139 is being raised, a thread wiper (not shown) moves the end of the cut thread hanging from second sewing head 118 away from the materials being sewn.

Figure 4B:
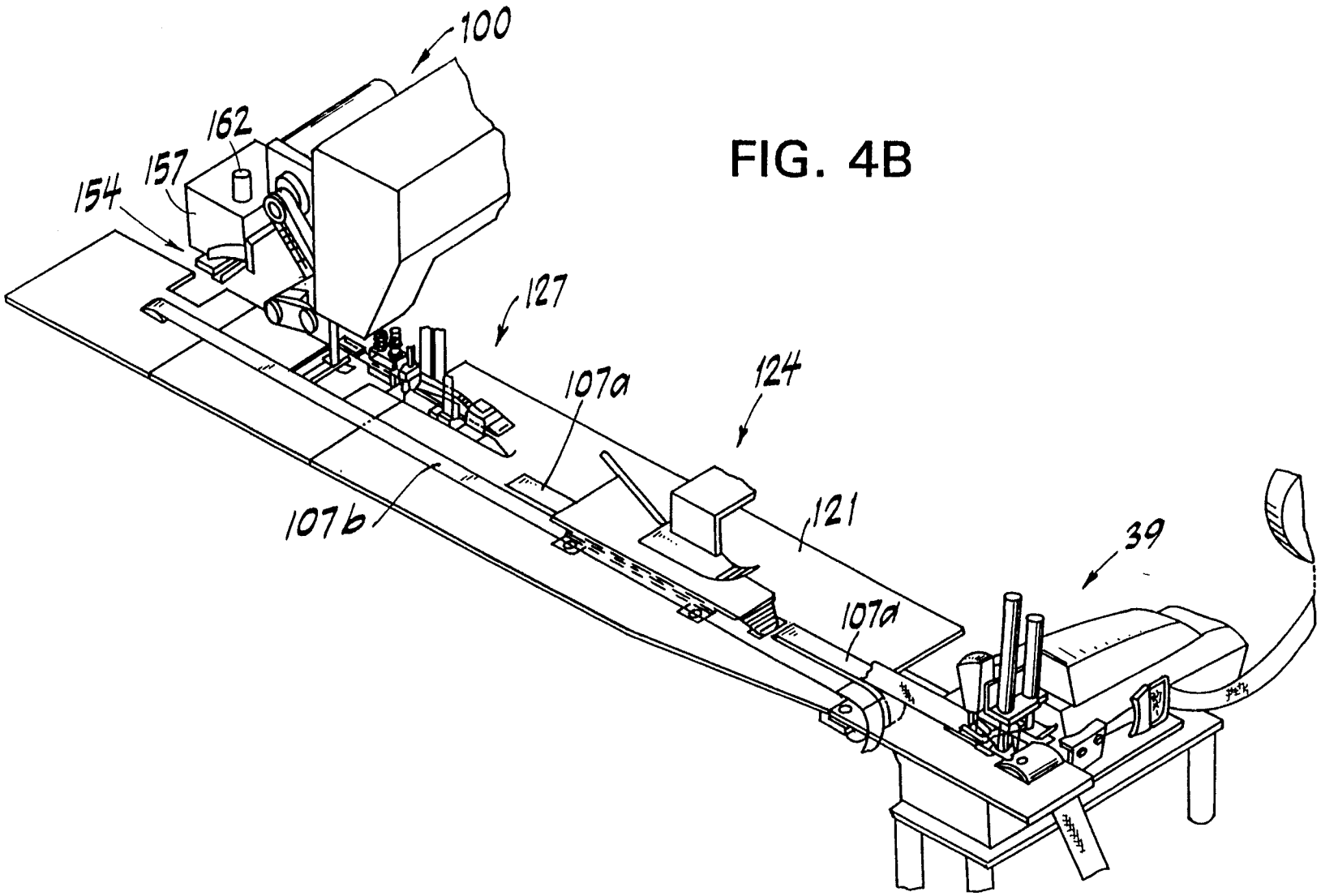
FIG. 4B is a top view of the embodiment of FIG. 4 showing the bottom conveyor systems and associated components of the apparatus.
Figure 4C:
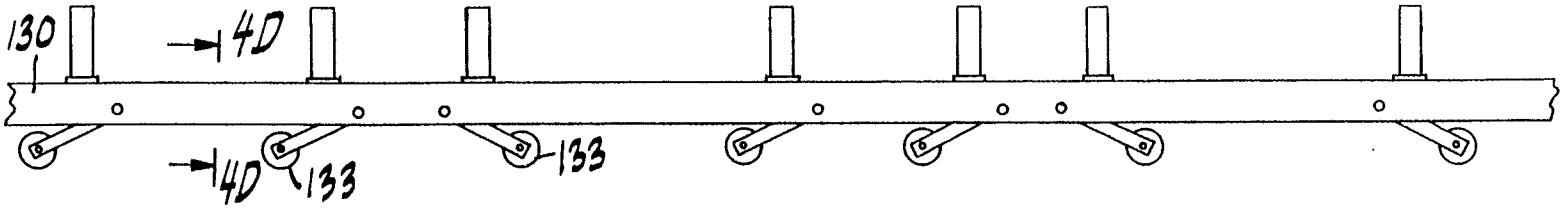
FIGS. 4C–4E illustrate the top conveyor mounting assembly and compliance rollers associated with the top conveyor system.
Figure 4E:
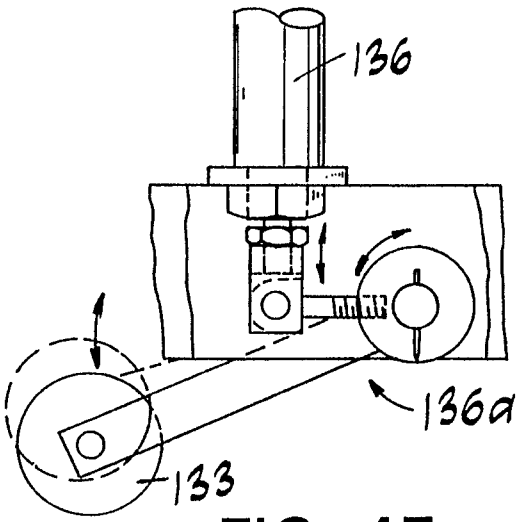
Figure 4D:
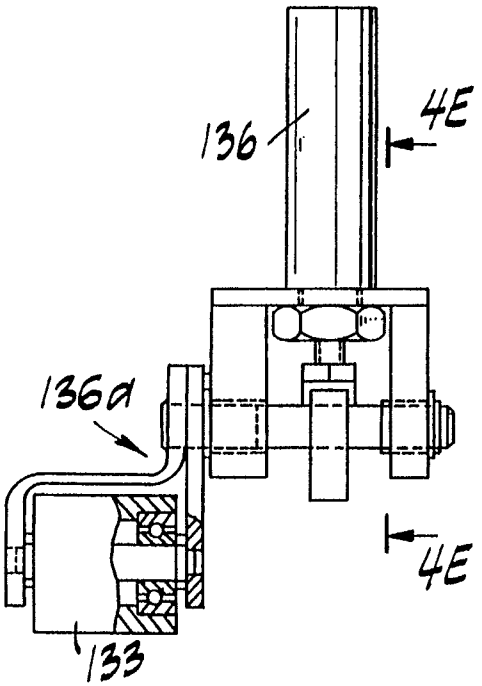

Referring to FIGS. 4A, 4B and 11, once top stitch 33 is sewn along the desired length of sewn assembly 150 and the thread has been severed, the conveyor belt systems 103, 107 transport the sewn assembly 150 past a fast action collar cutter 154 to sever the collarette material 22 at a desired point. The fast action cutter 154 is mounted onto a collar cutter carriage 157 to rapidly place the cutter 154 in the proper location for the cutting operation. A reflective or through-beam type sensor 162 is provided along work piece platform 121 along the path of the sewn assembly 150, and prior to its arrival at the cutter 154, to detect either the leading edge or trailing edge of the garment sewn assembly 150. Following a predetermined time interval after edge detection, the cutter carriage 157 rapidly places the cutter 154 into position to cut the collarette material, thereby separating the processed sewn assembly 150 from other garments still being processed at various points in the system. The cut is made "on the fly" (a quick action cut) to cut the collarette material 22 substantially perpendicular to its length. Following the cutting operation, collarette cutter carriage 157 retrieves cutter 154 to await the next processed garment.

When the collarette material 22 is severed, the sewing operations are completed, and the sewn assembly 150 is ready for the next manufacturing operation.

FIG. 12A is a schematic representation illustrating garment processing "zones" or manufacturing stages and the relationship between garment body 20, display 24, collarette 22 and label 26 during the various manufacturing stages of the sewn assembly. FIG. 12B is a simplified overhead view of the device further illustrating the manufacturing relationship of the garment components at the various zones depicted in FIG. 12A.

At the first zone, the collarette 22 is loaded through collarette feed rollers 63 and beneath guide plate 67 (FIG. 7). Zone 2 illustrates the arrangement of the materials during the first sewing operation. After garment body 20 has been loaded onto collarette 22, sewing begins after receipt of a "garment present" signal from garment detector 82. Then, after shoulder seam 32 has been sensed by sensor 83 to actuate operation first of the display feeder 65 and then the label feeder 70, the display 24 and label 26 are sewn along with collarette 22 and garment body 20 to complete sewing of the sewn assembly 150.

At zones 3–7, first unfolding mechanism 124 acts upon collarette 22 and display 24 to rotate these components approximately 180° about seam 28. At zone 7, the collarette 22 has been extended flush to the garment body, while display 24 rests atop the garment body so that the loose end of display 24 is to the side of seam 28.

At zones 7–10, second unfolding mechanism 127 acts upon the display to further rotate display 24 another 180° about seam 28. The result is that the loose end of display 24 will overlap both overedge seam 28 and a portion of label 26. The display is thereafter sewn in place by second sewing machine 100.

The flow chart of FIGS. 13A–D illustrates the sequence of steps performed by the controller 36 and the activities carried out by various components of the invention during processing of a finished sewn assembly.

To begin, the operator of the device progresses through an initial "power up" sequence (step 201) to initialize the system parameters necessary to process sewn assembly 150. Thus, at step 202, the controller 36 automatically initializes the system, including a set-up of the operating speeds of the various stepper motors 38, 109, 112, 115 and internal stitch counters so that the motors and components of the device will operate synchronously. The cutter carriage 157 is also commanded to its operative position.

At step 203, the operator enters at the control panel 37 garment parameters such as style, which are indicative of certain predetermined sewing constants (e.g., size of the garment, distance from the leading end of the garment body 20 to the shoulder seam 32, the label width, and the like) previously preprogrammed in the controller 36, necessary to enable accurate stitching of the components forming sewn assembly 150. Of course, it is understood that the operator may manually override the pre-programmed constants and make adjustments as need or desire dictate. Once entered, the device is primed for operation, and the operator need only commence the sewing cycle as herein described.

At step 204, the controller performs a self-check, determining, for example, whether the materials for collarette 22, label 26 and display 24, or the thread supplied from spools 102, 104, 106, are present (sensors 56*a*, 58*a*, 60*a*, 102*a*, 104*a*, 106*a* relay signals to controller 36). The system also determines whether label arm 72 is in its home position and whether a pre-cut label 26 is present in label gripper 74. At step 205, the controller 36 thus verifies the system checks performed at step 204 and determines if the system is ready for operation. If the system is not ready, an appropriate error message (step 205*a*) is sent to control panel 37 to alert the operator.

If the system is ready for operation, a garment body 20 may be loaded at the sewing area for sewing machine 39. The garment body is loaded until its leading edge is under presser foot 80. It will be apparent to those skilled in the art that the loading may be accomplished by manual or automated mechanisms.

Next, at step 206, the controller determines, through garment detector 82, whether garment body 20 is present at sewing machine 39. If not, the controller awaits the positioning of the garment body, but if the garment body is present, controller 36 progresses to step 207 to command presser foot 80 to descend upon garment body 20.

Controller 36 next determines whether the sew start switch (not shown) has been depressed by the operator (step 208). If so, then the sewing cycle (step 209) for both the sewing machines 39, 100 commences (these sewing cycles will be separately explained in accompanying FIGS. 13B (for sewing machine 39) and 13C (for sewing machine 100)). If the sew start switch has not been activated, the controller determines, at step 208*a*, whether garment body 20 may have been removed from the area of sewing machine 39. If it has, then the controller reverts to step 204 to check system status and otherwise prepare for the next processing cycle. If the garment is still present, the controller awaits activation of the start switch (step 208) to commence the sewing cycle (step 209). The sew start switch thus acts as a separate safety feature and control mechanism. Alternatively, as will be apparent, a highly trained operator could have the option of using an "auto start" mode where, once the garment is detected and after an adjustable time delay, sewing would start automatically without use of the sew start switch.

Figure 13A:
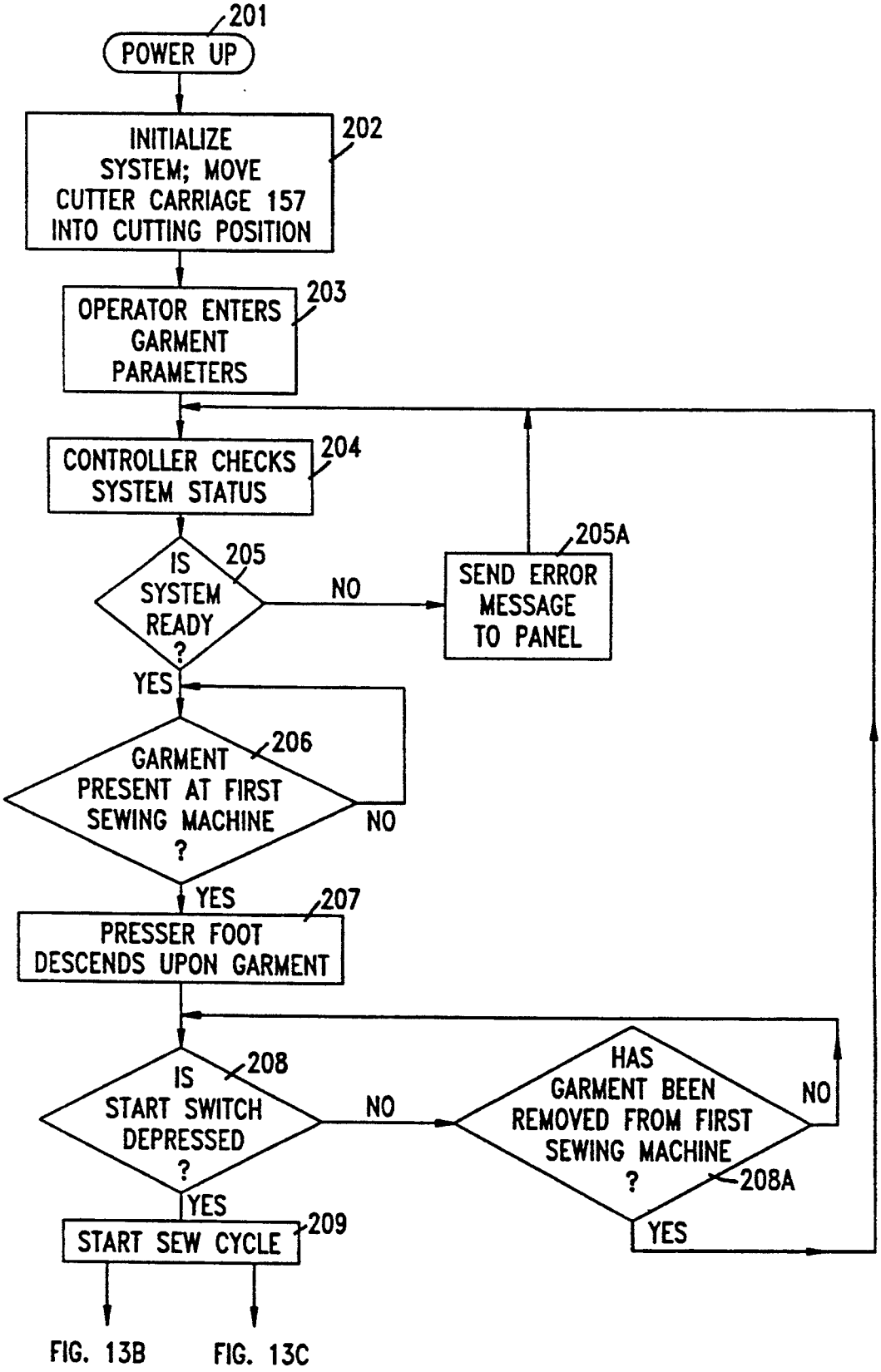
FIGS. 13A–D are a flow chart of the overall operation of the present invention.
Figure 13B:
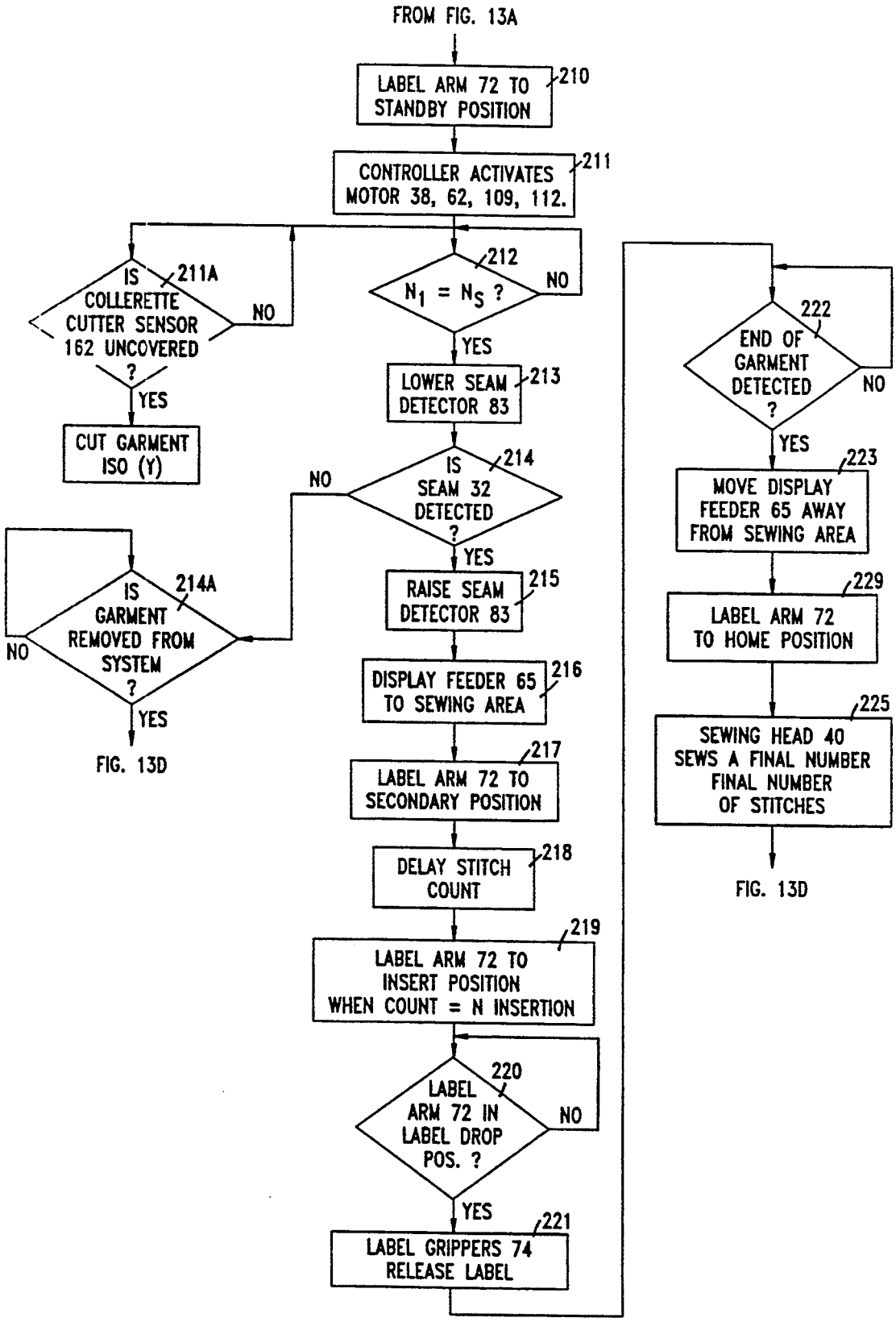
Figure 13C:
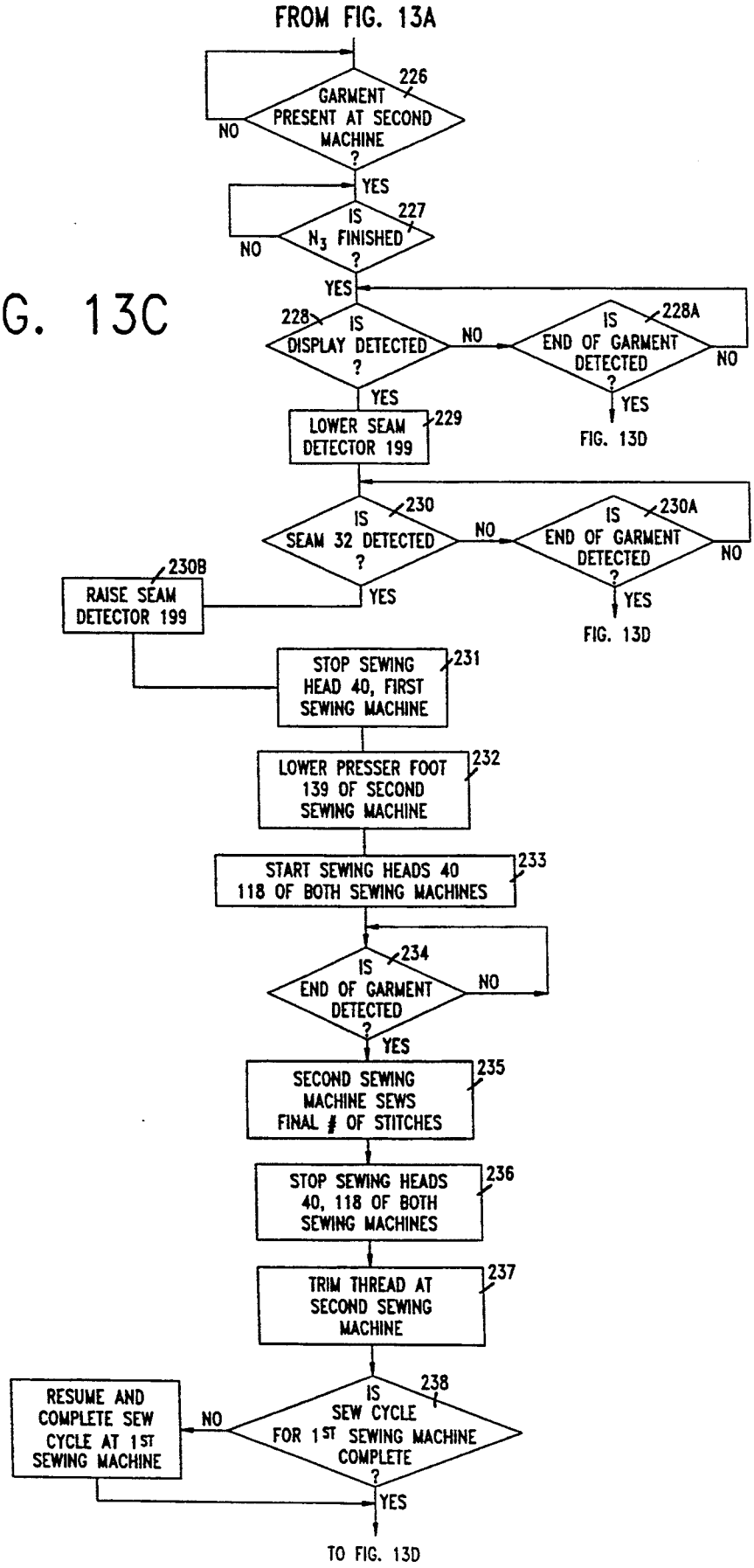

Reference is now made to FIGS. 13B and 13C to explain the concurrent operation of the sewing cycles performed by the first sewing machine 39 and the second sewing machine 100. It is understood that as one sewn assembly is being processed at the first sewing machine 39, the preceding sewn assembly in the system is simultaneously being processed at sewing machine 100; the sewing cycles for the two machines are separately illustrated and described for the sake of simplicity.

Referring to FIG. 13B, at step 210 controller 36 commands label arm 72 to lower into a standby position in preparation for inserting label 26 under sewing head 40. Rapidly thereafter, at step 211 controller 36 turns on the motor 38 to activate sewing head 40, turns on collarette motor 62 to drive collarette feed rollers 63; controller 36 also turns on motors 109, 112 to activate the upper and lower conveyor systems 103, 107. Thus, collarette material 22 is fed underneath garment body 20 and is thus sewn thereto by sewing head 40. The feed dogs 92, together with the frictional interference between collarette material 22/garment body 20, urge the components beneath presser foot 80 and through sewing head 40. The outside conveyor belts of the conveyor belt systems 103, 107 engage the garment body 20 as it progresses past sewing head 40, and the inside conveyor belts 103*a, b*, 107*a*, engage the collarette portion of the sewn assembly 150. Additionally, as previously described, the collarette feed rollers 63 maintain tension of the collarette material between rollers 63 and sewing head 40 to assure taut, even stitching. Simultaneous to step 211, at step 211*a*, the controller 36 is monitoring for the completion of a sewn assembly 150(y) in a greater state of processing (see FIG. 2) adjacent the collar cutter 154. When sensor 162 is uncovered, collarette material 22 of the completed sewn assembly 150(y) is cut by the collar cutter 154, so that sewn assembly 150(y) is ready for further processing operations.

At step 212, controller 36 determines whether the primary stitch count for sewing machine 39 ($N_1$) equals a predetermined stitch count ($N_S$) to activate seam detector 83. If not, the controller updates $N_1$until $N_S$ is detected. At that point, controller 36 lowers seam detector 83 over the sewing area (step 213) in preparation to detect shoulder seam 32. Seam 32 serves as a reference point for subsequent processing of the sewn assembly 150, and as such, the primary stitch count ($N_1$) is reset to a second total stitch count ($N_2$) once the seam is detected, and further counting of the stitches necessary for accurate placement of the display 24 and label 26 are measured from the onset of seam detection (step 214).

While the collarette 22 and garment body 20 are being forced and sewn under sewing head 40, controller 36 awaits detection of shoulder seam 32 (step 214). If not detected (step 214*a*) controller 36 determines, via garment sensor 82, whether the garment 20 has been removed from the system. If not removed (generally indicative that shoulder seam 32 has not yet passed beneath seam detector 83), then controller 36 awaits seam detection so that it can advance to progressive steps. If the garment has been removed, then the system advances to the "finish sew cycle" (FIG. 13D, step 239) to prepare the device to process a new sewn assembly yet to be loaded into the system.

After seam 32 is detected by seam detector 83 (step 214), controller 36 advances to step 215 to lift the seam detector away from the sewing area, permitting the operator complete access thereto. Next, controller 36 commands display inserter 64 to move display feeder 65 into the sewing area, as described above (step 216). Friction interference between the collarette 22 and display 24 causes display 24 to be drawn beneath presser foot 80 (and consequently, collarette 22) to be sewn onto collarette 22 and garment body 20. Meanwhile, label arm 72 is lowered to a secondary position (step 217) in anticipation of feeding a cut label 26 beneath sewing head 40.

At step 218, controller 36 momentarily delays the stitch count being maintained by the system since seam detection in order to ensure that the label 26 will be properly inserted beneath sewing head 40 so as to be sewn at a location corresponding to the center of the back neck portion of the collarette. Preferably, label feeding will commence at a stitch count, measured from seam detection, equalling the number of stitches to the center of the back neck portion of the collarette, less one-half the width of the label in stitch counts ($N_{insertion}=N_{to\ center\ of\ back\ of\ collarette}-0.5\times N_{WL}$). When the controller counts the proper number of stitches, label arm 72 descends to a final insert position at the sewing head 40 (step 219), thus bringing a precut label 26 into the sewing area and positioning same atop garment body 20 and beneath sewing head 40. Sewing head 40 thus sews the label 26 to the rest of the sewn assembly 150.

As the label is being sewn, the controller determines (via the stitch count) if the label arm has advanced to a label drop position (step 220) indicative of the label 26 being nearly completely sewn to the garment body 20. As soon as the controller determines that label arm 72 is in drop position, label grippers 74 open to release the label (step 221); the label arm 72 continues to move in synchronization with the sewing operation so as not to disturb completion of the sewing cycle.

Figure 13D:
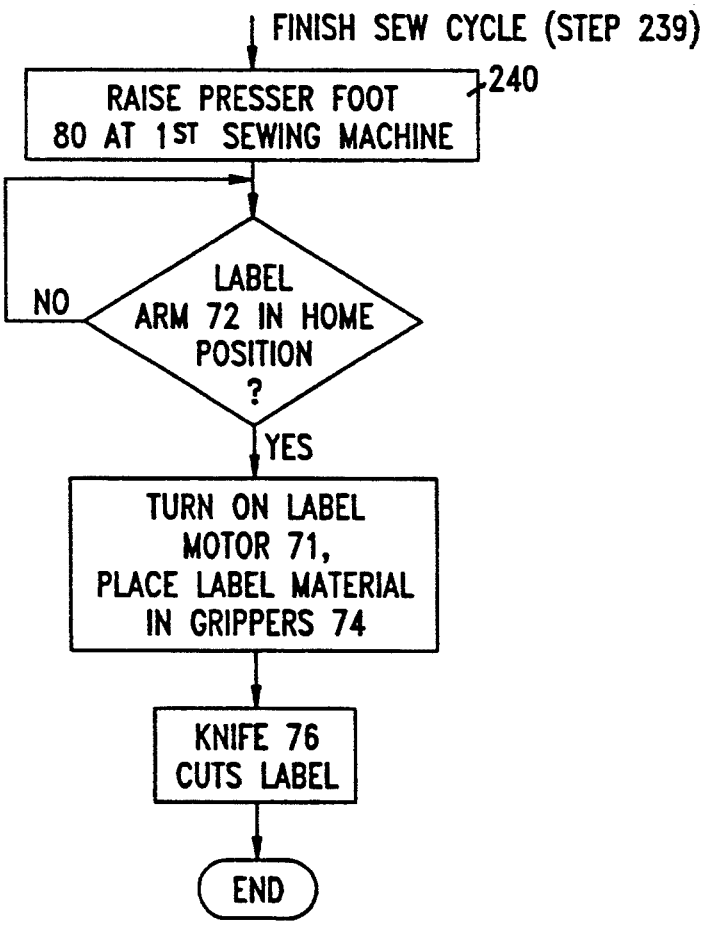

At step 222, the controller determines whether the end of the garment has been detected by garment detector 82. If so, then display feeder 65 is commanded away from the sewing area to end feeding of display material to the sewing head 40 (step 223); label arm 72 is raised to its home position to await the next sewing cycle (step 224); and a predetermined, final number of stitches are sewn to the sewn assembly 150 (step 225), ensuring that all components (garment body 20; collarette 22; display 24; and label 26) are out of sewing head 40. The system then advances to finish sew cycle (FIG. 13D, step 239).

Reference is now made to FIG. 13C to describe the sequence of operations occurring in processing sewn assembly 150 at sewing machine 100. Again, it is understood that a previous work piece in the system is being simultaneously processed at sewing machine 39 as described in FIG. 13B.

Following step 209 (FIG. 13A), processor 36 determines, via a second garment present sensor 82A (similar to garment sensor 82 located adjacent first sewing machine 39) whether a garment body 20 is present at second sewing machine 100 (step 226). As soon as the presence of a garment body is detected, controller 36 initializes a primary stitch count ($N_3$), based upon the preset dimensional parameters entered by the operator at step 203, and determines when that stitch count is finished (step 227) to establish a reference point and detection window useful for detecting the display 24 (step 228). As previously described, display 24 is detected by the display present sensor 186 located at the second unfolder 127.

During the time that display 24 has not yet been detected, controller 36 (via the second garment present sensor 82A) is actively monitoring for the end of the garment body 20 located adjacent the second sewing machine 39 (step 228*a*) to avoid an unnecessary sewing of the sewn assembly 150 should a display 24 not be detected by display present sensor 186. Generally, should a display 24 not be present, the end of the garment body 20 will be detected and controller 36 will proceed to the finish sew cycle (FIG. 13D, step 239) to await the end of processing of a preceding sewn assembly in the system at first sewing machine 39.

If a display is present and detected (step 228), controller 36 lowers seam detector 199 in preparation for detecting shoulder seam 32 to begin the sewing cycle at second machine 100. At step 230 the controller awaits detection of the shoulder seam 32. As described in step 228, the controller will constantly monitor for the end of the garment body (step 230*a*) during the time that the shoulder seam remains undetected. If the end of the garment body 20 is detected before the shoulder seam, the system will proceed to the finish sew cycle (FIG. 13D, step 239) to await the end of processing of a preceding sewn assembly at first sewing machine 39.

If a garment body is present, shoulder seam 32 will be detected before the end of the garment body and the controller 36 advances to the heart of the sewing cycle. At step 230*b*, the seam detector 199 is raised. At step 230, controller 36 commands sewing head 40 of the first sewing machine 39 to momentarily stop; this allows adequate time for presser foot 139 of the second sewing machine to descend (step 232) and engage its sewn assembly, thereby avoiding a potential jam-up of the sewn assemblies being processed in the system should the first sewing machine 39 continue to sew its sewn assembly. As soon as presser foot 139 has descended (step 232), both sewing heads 40, 118 commence sewing (step 233). The covering seam 33 is thus applied to hold the display 24 in place.

Sewing machine 100 continues to sew the display in place while the system continues monitoring for the end of garment body 20 at the second sewing machine 100 (step 234). Once detected, a preset final number of stitches is applied by the second machine 100 to remove the sewn assembly from beneath sewing head 118 (step 235). Next, both sewing machines 39 and 100 are stopped (step 236) to permit the second sewing machine to properly trim its thread (step 237). Conveyor systems 103, 107 transport the sewn assembly just processed at the second sewing machine 100 to be severed by collar cutter 154.

After the thread has been trimmed at second sewing machine 100, the controller 36 continues to monitor whether the cycle for first sewing machine 39 (FIG. 13B) has been completed (step 238). When the controller determines that this cycle is complete (or, if not, after controller 36 has commanded the first sewing machine 39 at step 238*a* to resume and complete its sewing cycle), controller 36 proceeds to the finish sew cycle (FIG. 13D, step 239).

FIG. 13D illustrates the finish sew cycle (step 239), which completes the overall garment processing cycle in preparation for preparing the device for the next garment processing cycle. Presser foot 80 is raised at the first sewing machine 39 (step 240). Controller 36 makes sure that label arm 72 is in its home position (step 241), and when it is, label feed motor 71 is actuated to place label material 26 between grippers 74 (step 242). An individual label is cut by the hot knife 76 (step 243) so that the gripper 74 holds a cut label. The system is now primed and ready to detect the presence of garment body 20 at the first sewing area (step 206), beginning the manufacturing cycle anew. If a garment size or style change is contemplated the operator can re-enter the parameters (step 203) before re-commencing the manufacturing cycle.

As will become readily apparent to those skilled in the art, the display feeder and label feeder can be deactivated to vary the finished product. For example, the label feed mechanism 70 can be deactivated so that when the apparatus is operated, only a collarette and display will be sewn to the garment body. Similarly, the display feeder can be deactivated such that only a collarette and label will be sewn to the garment body.

Figure 1A:
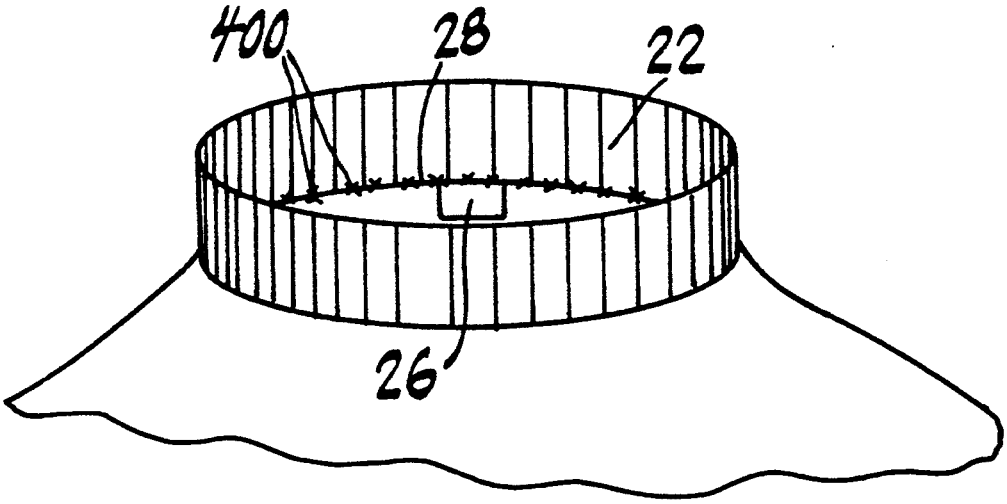
FIG. 1A illustrates a planar view of a garment with the display deleted, with a chain stitch covering the back portion of the collarette from shoulder to shoulder.
Figure 1B:
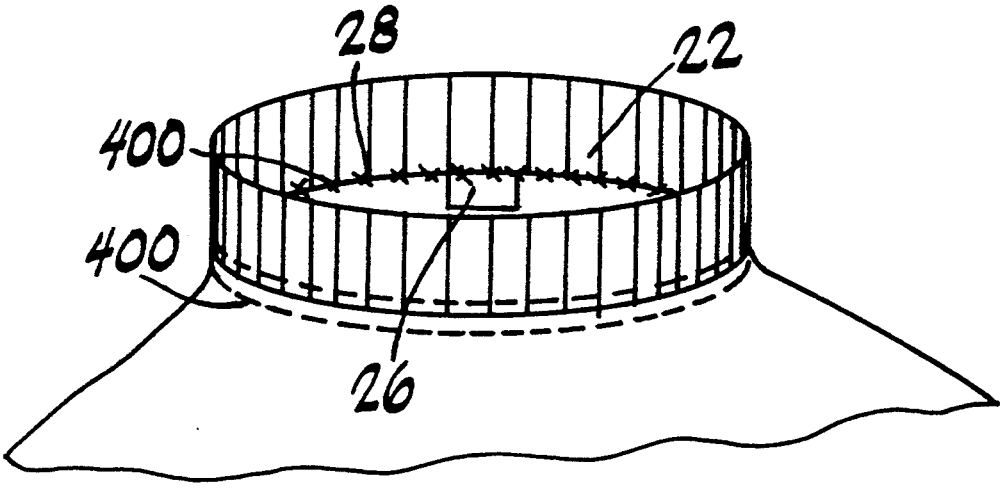
FIG. 1B illustrates a planar view of a garment with the display deleted, with a chain stitch sewn around the entire collarette.
Figure 1C:
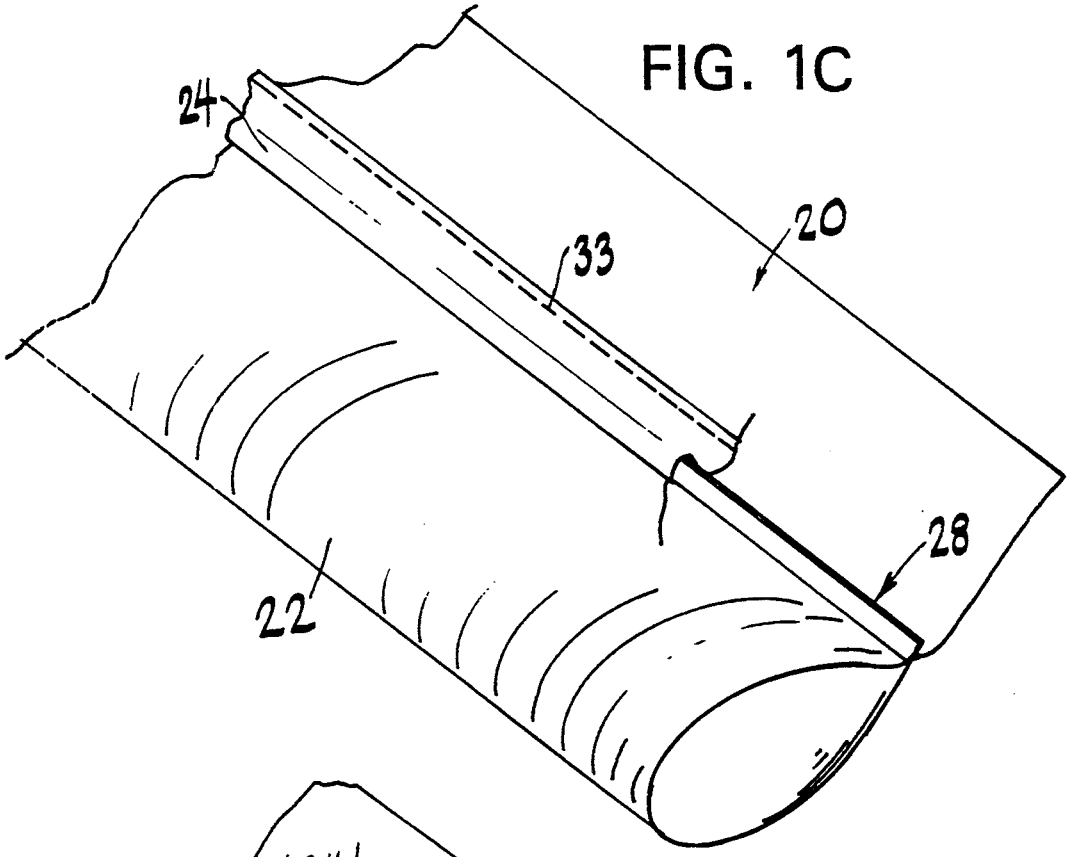
FIG. 1C illustrates a planar view of a modified lengthwise display construction covering the overedge seam.
Figure 1D:
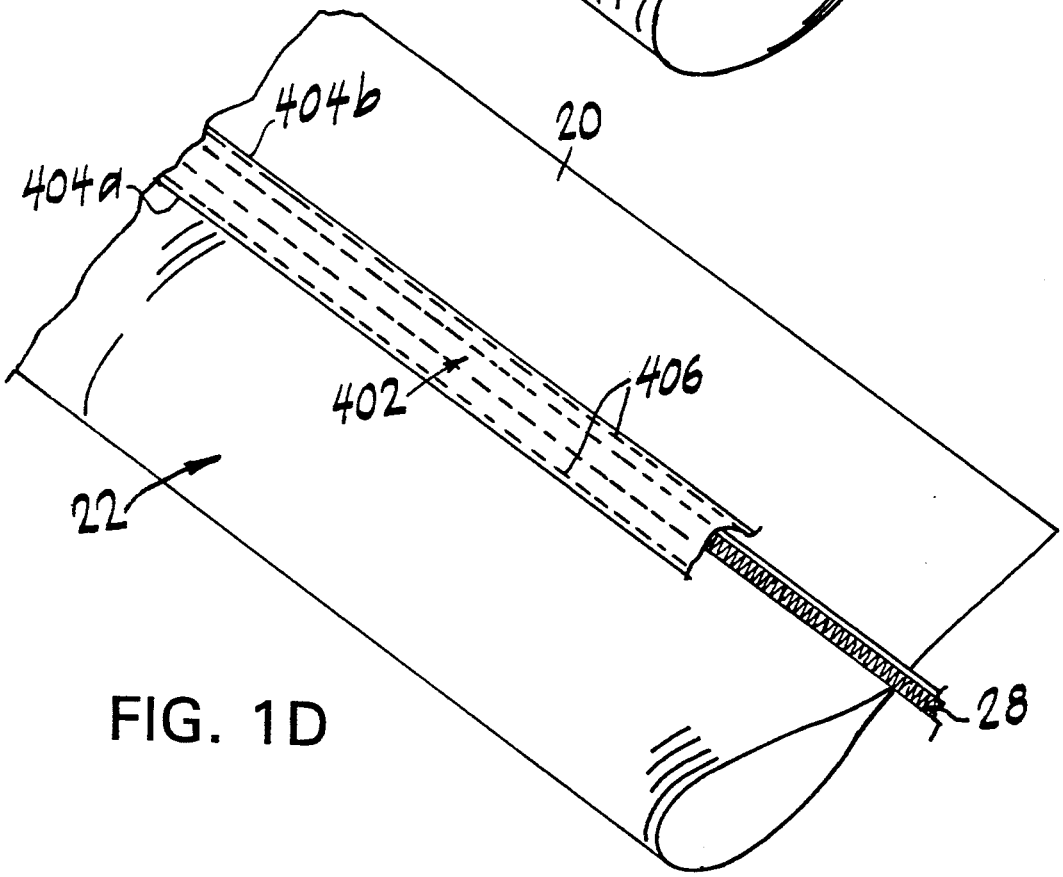
FIGS. 1D and 1E illustrate planar and cross-sectional views, respectively, of a modified construction of a lengthwise tape covering the overedge seam.
Figure 1E:
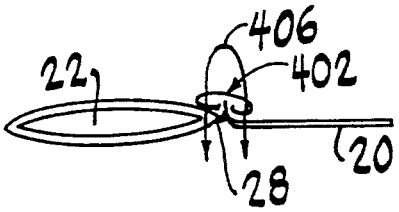

For example, in certain instances, the completed garment may be sewn so that display 24 is omitted from construction of the garment. The second sewing operation may then be implemented to cover the length of the overedge seam 28, in whole or in part, with a covering stitch. This covering stitch 400, which overlies and covers overedge seam 28, provides a more aesthetic presentation of the finished garment, and serves to lessen or eliminate potential annoyance experienced by a garment wearer with an otherwise exposed overedge seam 28 placed flush against the body of the wearer. Examples of such covering stitch construction are illustrated in FIGS. 1A and 1B. As known to those skilled in the art, the covering stitch 400 can entail, for example, a modified 406 EFa-1 cover stitch, which is stitched over overedge seam only around a back portion of collarette 22 (FIG. 1A). Alternatively, the modified 406 EFa-1 cover stitch 400 may be stitched over overedge seam 28 around the entire length of collarette 22 (FIG. 1B). Moreover, with modification, the device can be configured to cover the entire length of overedge seam 28 with the display 24 running all around the length of the collarette (FIG. 1C). Alternatively, as shown in FIGS. 1D and 1E, the device may be modified to attach a covering tape 402 to cover the length of seam 28. The tape 402 is sewn at its free edges 404*a* and *b* with a holding stitch 406. Other modifications will be apparent to those skilled in the art.

Additionally, as will become apparent to those skilled in the art, the synchronization of inserting the display and tape need not be dependent on stitch count. For example, timed synchronization can be used to command the display feeder and label feeder at the appropriate times.

Although illustrative preferred embodiments have thus been described herein in detail, it should be noted and will be appreciated by those skilled in the art that numerous variations may be made within the scope of this invention without departing from the principle of the invention and without sacrificing its advantages. The terms and expressions have been used as terms of description and not terms of limitation. There is no intention to use the terms or expressions to exclude any equivalents of features shown and described or portions thereof and the invention should be interpreted in accordance with the claims which follow.

We claim:

1. An apparatus for sewing a collarette, label and display to a garment body comprising:

a first sewing machine having a first sewing head for sewing said collarette, label and display to said garment body to form a sewn assembly;

a collarette feed means for feeding collarette material under said first sewing head and causing said collarette material to be sewn to said garment body;

a display feed means for feeding display material under said sewing head on command and causing said display material to be sewn to said garment body and said collarette material;

a label feed means for feeding a label under said sewing head on command and causing said label to be sewn to said garment body and said collarette material;

a second sewing machine having a second sewing head for applying a second sewing operation to said display;

means for transporting said sewn assembly from said first sewing machine to said second sewing machine; and a controller means for controlling operation of said apparatus.

2. An apparatus according to claim 1, wherein said garment body further includes a shoulder seam, further comprising seam detector means for detecting said shoulder seam to activate operation of said sewing heads.

3. An apparatus for sewing a collarette, label and display to a garment body, said garment body having a shoulder seam, comprising:

a first sewing machine having a sewing head for sewing said collarette, label and display to said garment body to form a sewn assembly;

a second sewing machine having a sewing head for applying a second sewing operation to said display;

means for transporting said sewn assembly from said first sewing machine to said second sewing machine; and controller means for controlling operation of said apparatus, further comprising means for orienting said collarette and said display into position for sewing said display at said second sewing machine.

4. A apparatus according to claim 3, wherein said means for orienting comprises:

a first unfolding means for orienting said collarette and display from beneath sewn assembly; and a second unfolding means for orienting said display into position for sewing at said second sewing machine.

5. An apparatus for sewing a collarette, label and display to a garment body, said garment body having a shoulder seam, comprising:

a first sewing machine having a sewing head for sewing said collarette, label and display to said garment body to form a sewn assembly;

a second sewing machine having a sewing head for applying a second sewing operation to said display;

means for transporting said sewn assembly from said first sewing machine to said second sewing machine; and controller means for controlling operation of said apparatus, further comprising seam detector means for detecting said shoulder seam, said seam detector thereby relaying signals to said controller means for controlling operation of said apparatus.

6. An apparatus for sewing a collarette, display, and label to a garment body having a leading edge, a trailing edge, and a shoulder seam, comprising:

a first sewing machine having a first sewing head for sewing said collarette, label and display with a joining seam to said garment body to form a sewn assembly;

a collarette feed means for feeding collarette material under said first sewing head and causing said collarette material to be sewn to said garment body;

a display feed means for feeding display material under said first sewing head on command and causing said display material to be sewn to said garment body and said collarette material;

a label feed means for feeding a label under said first sewing head on command and causing said label to be sewn to said garment body, collarette material, and display material;

a second sewing machine having a second sewing head for applying a second sewing operation to said display;

means for transporting said sewn assembly from said first sewing machine to said second sewing machine;

means for orienting positioned along the path of said means for transporting for orienting said collarette and display into position for sewing said display at said second sewing machine; and controller means for controlling operation of said apparatus.

7. An apparatus according to claim 6 further comprising seam detector means for detecting said shoulder seam;

said controller commanding said display feeder when said seam detector detects said shoulder seam; and said controller commanding said label feed means when the total number of stitches counted equals a predetermined value.

8. The apparatus according to claim 6, wherein said means for orienting comprises:

a first unfolder having an angled wall portion for unfolding said collarette and display from beneath said garment body to rest flush in the plane of said garment body; and a second unfolder having an angled wall portion for unfolding said display to cover said joining seam.

9. The apparatus according to claim 8, wherein said second unfolder includes display detection means for detecting the presence of a display on said sewn assembly.

10. The apparatus according to claim 6, wherein said means for transporting comprises a top conveyor assembly and a bottom conveyor assembly, said top conveyor assembly disposed on a carriage rotatably affixed to said apparatus for selectively positioning said top conveyor assembly into or out of engagement with said lower conveyor assembly.

11. The apparatus according to claim 6, further comprising:

a display presser means adjacent said second sewing head for pressing said display into position before sewing at said second sewing head; and a rear puller assembly adjacent said second sewing head for urging said sewn assembly away from said second sewing machine during sewing.

12. The apparatus according to claim 6, wherein said seam detector means comprises a spring loaded paddle pivotally affixed adjacent to a proximity sensor, said paddle disposed to be pivotally biased away from said proximity sensor when engaged by said shoulder seam to cause said proximity sensor to relay a seam detection signal to said controller.

13. The apparatus according to claim 12, wherein said seam detector means is disposed adjacent each of said first sewing machine and said second sewing machine.

14. The apparatus according to claim 6, further comprising a collarette cutter adjacent said second sewing machine for severing said collarette material once said display has been sewn by said second sewing machine.

15. The apparatus according to claim 10, wherein said top conveyor assembly includes a continuation outwall top belt and a plurality of inside top belts; and said bottom conveyor assembly includes a long continuous outside bottom belt and a short inside bottom belt.

16. The apparatus of claim 15, further comprising a plurality of compliance rollers selectively engageably with said outside top belt for pressing said outside top belt against said outside bottom belt when said top conveyor assembly is engaged with said bottom conveyor assembly.

17. An apparatus for sewing a collarette and label to a garment body comprising:

a first sewing machine having a first sewing head for applying a joining seam to join said collarette and label to said garment body to form a sewn assembly;

a collarette feed means for feeding collarette material under said first sewing head and causing said collarette material to be sewn to said garment body;

a label feed means for feeding a label under said sewing head on command and causing said label to be sewn to said garment body and said collarette material;

a second sewing machine having a second sewing head for applying a second sewing operation over said joining seam;

means for transporting said sewn assembly from said first sewing machine to said second sewing machine; and a controller means for controlling operation of said apparatus.

18. A method for sewing a collarette, display and label to a garment body having a shoulder seam comprising the steps of:

loading said garment body under a first sewing machine sewing head;

feeding collarette material under said first sewing machine sewing head and causing said collarette material to be sewn to said garment body;

feeding display material under said first sewing machine sewing head on command and causing said display material to be sewn to said garment body and said collarette material;

feeding a cut label under said first sewing head to be sewn to said garment body;

unfolding said collarette and display from beneath said garment body to position said collarette and display for a second sewing operation; and sewing said display in place at a second sewing machine sewing head.

19. A method according to claim 18 further comprising the steps of detecting said shoulder seam; and commanding said display feed means when said seam detector means detects said shoulder seam.

20. A method for sewing a collarette, display and label to a garment body with a joining seam, said garment body having a shoulder seam, comprising the steps of:

loading said garment body under a first sewing machine sewing head;

feeding collarette material under said first sewing head and causing said collarette material to be sewn to said garment body;

detecting said shoulder seam;

feeding said display material under said first sewing machine sewing head upon detection of said shoulder seam and causing said display material to be sewn to said garment body and said collarette material;

feeding a cut label under said first sewing head to be sewn to said garment body;

conveying said garment body, display, collarette and label to first unfolding means;

unfolding said collarette and display at said first unfolding means from beneath said garment body to position said collarette and display to a side of said joining seam and in the plane of said garment body;

conveying said garment body, display label and collarette to a second unfolding means;

folding said display at said second unfolding means to cover said joining seam;

conveying said garment body, collarette, display and label to a second sewing machine;

sewing said display to said garment body at said second sewing machine; and severing said collarette once said display has been sewn.

21. The method according to claim 20 further comprising the step of detecting the presence of said display at said second unfolding means.

22. A method for joining with a joining seam a collarette, a display, and a label having a width, to a garment body having a leading edge, a trailing edge, and a shoulder seam comprising the steps of:

loading said garment body under a first sewing machine sewing head;

feeding collarette material under said first sewing machine sewing head and causing said collarette material to be sewn to said garment body;

feeding display material under said first sewing machine sewing head on command and causing said display material to be sewn to said garment body and said collarette material;

feeding said label under said first sewing machine sewing head on command and causing said label to be sewn to said garment body, said collarette material, and said display material;

conveying said garment body, collarette, label and display to means for orienting said collarette and display into position for a second sewing operation;

re-orienting said collarette and display to position said display to cover said joining seam;

conveying said garment body, collarette, display and label to a second sewing machine sewing head; and sewing said display to said garment body at said second sewing machine sewing head.

23. A method according to claim 22 further comprising the steps of;

counting the total number of stitches performed by said first sewing machine;

detecting said shoulder seam;

commanding display feeding when said shoulder seam is detected; and commanding label feeding when the total number of stitches counted equals a predetermined value.

24. A method according to claim 23 wherein said predetermined value equals the total number of stitches from the start of a sewing operation to seam detection multiplied by a ratio factor less one half said label width in stitch counts.

25. A method according to claim 24 wherein said ratio factor equals one half a distance from said shoulder seam to said trailing edge divided by a distance from said leading edge to said shoulder seam.

* * * * *